US005307441A

United States Patent [19]

Tzeng

[11] Patent Number: 5,307,441

[45] Date of Patent: Apr. 26, 1994

[54] WEAR-TOLL QUALITY 4.8 KBPS SPEECH CODEC

[75] Inventor: Forrest F.-T. Tzeng, Rockville, Md.

[73] Assignee: Comsat Corporation, Bethesda, Md.

[21] Appl. No.: 442,830

[22] Filed: Nov. 29, 1989

[51] Int. Cl.[5] ..... G10L 9/02

[52] U.S. Cl. ..... 395/2.31; 395/2.62

[58] Field of Search ..... 381/29-41, 381/51-53, 29-41, 46, 47; 364/513.5; 375/122; 395/2.31, 2.62

[56] References Cited

U.S. PATENT DOCUMENTS

| | | | |
|---|---|---|---|
| 4,184,049 | 1/1980 | Crochiere et al. | 381/31 |
| 4,410,763 | 10/1983 | Strawczynski et al. | 381/41 |
| 4,696,041 | 9/1987 | Sakata | 395/2 |
| 4,821,325 | 4/1989 | Martin et al. | 381/41 |
| 4,860,355 | 8/1989 | Copperi | 381/36 |
| 4,868,867 | 9/1989 | Davidson et al. | 381/36 |
| 4,896,361 | 1/1990 | Gerson | 381/40 |
| 4,899,385 | 2/1990 | Ketchum et al. | 381/36 |
| 4,969,192 | 11/1990 | Chen et al. | 381/31 |

*Primary Examiner*—Michael R. Fleming
*Assistant Examiner*—Michelle Doerrler
*Attorney, Agent, or Firm*—Sughrue, Mion, Zinn, Macpeak & Seas

[57] ABSTRACT

A speech codec operating at low data rates uses an iterative method to jointly optimize pitch and gain parameter sets. A 26-bit spectrum filter coding scheme may be used, involving successive subtractions and quantizations. The codec may preferably use a decomposed multipulse excitation model, wherein the multipulse vectors used as the excitation signal are decomposed into position and amplitude codewords. Multipulse vectors are coded by comparing each vector to a reference multipulse vector and quantizing the resulting difference vector. An expanded multipulse excitation codebook and associated fast search method, optionally with a dynamically-weighted distortion measure, allow selection of the best excitation vector without memory or computational overload. In a dynamic bit allocation technique, the number of bits allocated to the pitch and excitation signals depend on whether the signals are "significant" or "insignificant". Silence/speech detection is based on an average signal energy over an interval and a minimum average energy over a predetermined number of intervals. Adaptive post-filter and the automatic gain control schemes are also provided. Interpolation is used for spectrum filter smoothing, and an algorithm is provided for ensuring stability of the spectrum filter. Specially designed scalar quantizers are provided for the pitch gain and excitation gain.

42 Claims, 12 Drawing Sheets

NFR: # OF CONSECUTIVE SPEECH FRAMES IMMEDIATELY PRECEDING THE PRESENT FRAME

HC: HANGOVER COUNTER

| | PITCH SYNTHESIZER | GAIN & EXCITATION SIGNAL | |
|---|---|---|---|
| | | 1st STAGE | 2nd STAGE |
| 1 | 0 | $B_G, B_e$ or $B_G, B_e$ | $B_G, B_e$ / $B_G, B_p - B_G$ |
| 2 | $B_p$ | $B_G, B_e$ or $B_G, B_e$ or $B_G, B_e$ | 0 / $B_G, B_p - B_G$ / $B_G, B_e$ |
| 3 | $B_p$ | 0 | |

WEAR-TOLL QUALITY 4.8 KBPS SPEECH CODEC

BACKGROUND OF THE INVENTION

For many applications, e.g., mobile communications, voice main, secure voice, etc., a speech codec operating at 4.8 kbps and below with high-quality speech is needed. However, there is no known previous speech coding technique which is able to produce near-toll quality speech at this data rate. The government standard LPC-10, operating at 2.4 kbps, is not able to produce natural-sounding speech. Speech coding techniques successfully applied in higher data rates (>10 kbps) completely break down when tested at 4.8 kbps and below. To achieve the goal of near-toll quality speech at 4.8 kbps, a new speech coding method is needed.

A key idea for high quality speech coding at a low data rate is the use of the "analysis-by-synthesis" method. Based on this concept, an effective speech coding scheme, known as Code-Excited Linear Prediction (CELP), has been proposed by M. R. Schroeder and B. S. Atal, "Code-Excited Linear Prediction (CELP): High Quality Speech at Very Low Bit Rates", Proc. Int. Conf. Acoust., Speech, and Signal Processing (ICASSP), pp. 937–940, 1985. CELP has proven to be effective in the areas of medium-band and narrow-band speech coding. Assuming there are $L=4$ excitation subframes in a speech frame with size $N=160$ samples, it has been shown that an excitation codebook with 1024, 40-dimensional random Gaussian codewords is enough to produce speech which is indistinguishable from the original speech. For the actual realization of this scheme, however, there still exist several problems.

First, in the original scheme, most of the parameters to be transmitted, except the excitation signal, were left uncoded. Also, the parameter update rates were assumed to be high. Hence, for low-date-rate applications, where there are not enough data bits for accurate parameter coding and high update rates, the 1024 excitation codewords become inadequate. To achieve the same speech quality with a fully-coded CELP codec, a data rate close to 10 kbps is required.

Secondly, typical CELP coders use random Gaussian, Laplacian, uniform, pulse vectors or a combination of them to form the excitation codebook. A full-search, analysis-by-synthesis, procedure is used to find the best excitation vector from the codebook. A major drawback of this approach is that the computational requirement in finding the best excitation vector is extremely high. As a result, for real-time operation, the size of the excitation codebook has to be limited (e.g., <1024) if minimal hardware is to be used.

Thirdly, with the excitation codebook, which contains 1024, 40-dimensional random Gaussian codewords, a computer memory space of $1024\times40=40960$ words is required. This memory space requirement for the excitation codebook alone has already exceeded the storage capabilities of most of the commercially available DSP chips. Many CELP coders, hence, have to be designed with a smaller-sized excitation codebook. The coder performance, therefore, is limited, especially for unvoiced sounds. To enhance the coder performance, an effective method to significantly increase the codebook size without a corresponding increase in the computational complexity (and the memory requirement) is needed.

As described above, there are not enough data bits for accurate excitation representation at 4.8 kbps and below. Comparing the CELP excitation to the ideal excitation, which is the residual signal after both the short-term and the long-term filters, there is still considerable discrepancy. Thus, several critical parts of a CELP coder must be designed carefully. For example, accurate encoding of the short-term filter is found important because of the lack of excitation compensation. Also, appropriate bit allocation between the long-term filter (in terms of the update rate) and the excitation (in terms of the codebook size) is found necessary for good coder performance. However, even with complicated coding schemes, toll-quality is still hardly achieved.

Multipulse excitation, as described by B. S. Atal and J. R. Remde, "A New Model of LPC Excitation for Producing Natural-Sounding Speech at Low Bit Rates", proc. ICASSP, pp. 614–617, 1982, has proven to be an effective excitation model for linear predictive coders. It is a flexible model for both voiced and unvoiced sounds, and it is also a considerably compressed representation of the ideal excitation signal. Hence, from the encoding point of view, multipulse excitation constitutes a good set of excitation signals. However, with typical scalar quantization schemes, the required data rate is usually beyond 10 kbps. To reduce the data rate, either the number of excitation pulses has to be reduced by better modelling of the LPC spectral filter, e.g., as described by I. M. Transcoso, L. B. Almeida and J. M. Tribolet, "Pole-Zero Multipulse Speech Representation Using Harmonic Modelling in the Frequency Domain", ICASSP, pp. 7.8.1–7.8.4., 1985, and/or more efficient coding methods have to be used. Applying vector quantization, e.g., as described by A. Buzo, A. H. Gray, R. M. Gray, and J. P. Market, "Speech Coding Based Upon Vector Quantization", IEEE Tran. Acoust., Speech, and Signal Processing, pp. 562–574, October, 1980, directly to the multipulse vectors is one solution to the latter approach. However, several obstacles, e.g., the definition of an appropriate distortion measure and the computation of the centroid from a cluster of multipulse vectors, have hindered the application of multipulse excitation in the low-bit-rate area.

Hence, for the application of CELP codec structure to 4.8 kbps speech coding, careful compromise system design and effective parameter coding techniques are necessary.

SUMMARY OF THE INVENTION

It is an object of the present invention to overcome the above-discussed and other drawbacks of prior art speech codecs, and a more particular object of the invention to provide a near-toll quality 4.8 kbps speech codec.

These and other objects are achieved by a speech codec employing one or more of the following novel features:

An iterative method to jointly optimize the parameter sets for a speech codec operating at low data rates;

A 26-bit spectrum filter coding scheme which achieves identical performance as the 41-bit scheme used in the Government LPC-10;

The use of a decomposed multipulse excitation model, i.e., wherein the multipulse vectors used as the excitation signal are decomposed into position and amplitude codewords, to achieve a significant reduction in the memory requirements for storing the excitation codebook;

Application of multipulse vector coding to medium band (e.g., 7.2–9.6 kbps) speech coding;

An expanded multipulse excitation codebook for performance improvement without memory overload;

An associated fast search method, optionally with a dynamically-weighted distortion measure, for selecting the best excitation vector from the expanded excitation codebook for performance improvement without computational overload;

The dynamic allocation and utilization of the extra data bits saved from insignificant pitch synthesizer and excitation signals;

Improved silence detection, adaptive post-filter and the automatic gain control schemes;

An interpolation technique for spectrum filter smoothing;

A simple scheme to ensure the stability of the spectrum filter;

Specially designed scalar quantizers for the pitch gain and excitation gain;

Multiple methods for testing the significance of the pitch synthesizer and the excitation vector in terms of their contributions to the reconstructed speech quality; and System design in terms of bit allocation tradeoffs to achieve the optimum codec performance.

BRIEF DESCRIPTION OF THE DRAWINGS

The invention will be more clearly understood from the following description in conjunction with the accompanying drawings, wherein:

FIG. 4(*b*) is a block diagram further illustrating the interframe predictive coating scheme of FIG. 4(*a*);

DETAILED DESCRIPTION OF THE INVENTION

Figure 1:
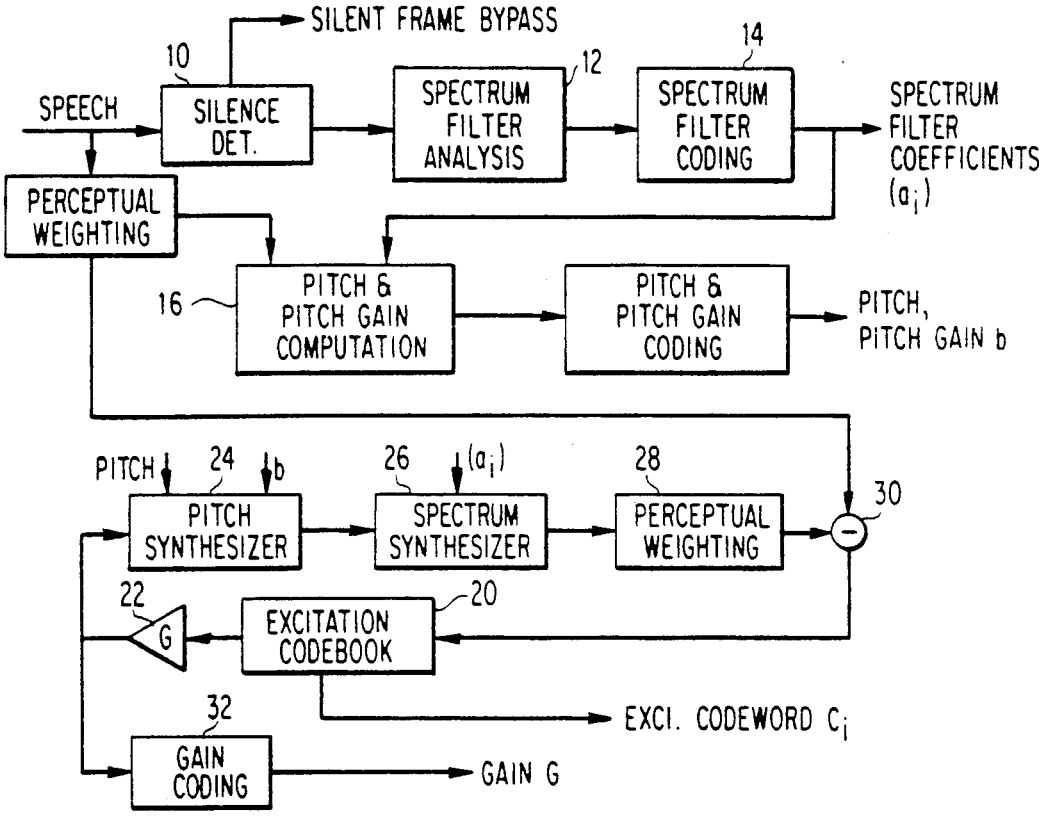
FIG. 1 is a block diagram of the encoder side of an analysis-by-synthesis speech codec.

A block diagram of the encoder side of a speech codec is shown in FIG. 1. An incoming speech frame (e.g., sampled at 8 kHz) is provided to a silence detector circuit 10 which detects whether the frame is a speech frame or a silent frame. For a silent frame, the whole encoding/ decoding process is by-passed to save computation. White Gaussian noise is generated at the decoding side as the output speech. Many algorithms for silence detection would be suitable, with a preferred algorithm being described in detail below.

If silence detector 10 detects a speech frame, a spectrum filter analysis is first performed in spectrum filter analysis circuit 12. A 10th-order all-pole filter model is assumed. The analysis is based on the autocorrelation method using non-overlapping Hamming-windowed speech. The ten filter coefficients are then quantized in coding circuit 14, preferably using a 26-bit scheme described below. The resultant spectrum filter coefficients are used for the subsequent analyses. Suitable algorithms for spectrum filter coding are described in detail below.

The pitch and the pitch gains are computed in pitch and pitch gain computation circuit 16, preferably by a closed-loop procedure as described below. A third-order pitch filter generally provides better performance than a first-order pitch filter, especially for high frequency components of speech. However, considering the significant increase in computation, a first-order pitch filter may be used. The pitch and the pitch gain are both updated three times per frame.

In pitch and pitch gain coding circuit 18, the pitch value is exactly coded using 7 bits (for a pitch range from 16 to 143 samples), and the pitch gain is quantized using a 5-bit scalar quantizer.

The excitation signal and the gain term G are also computed by a closed-loop procedure, using an excitation codebook 20, amplifier 22 with gain G, pitch synthesizer 24 receiving the amplified gain signal, the pitch and the pitch gain as inputs and providing a synthesized pitch, the spectrum synthesizer 26 receiving the synthesized pitch and spectrum filter coefficients $a_i$ and providing a synthesized spectrum of the received signal, and a perceptual weighting circuit 28 receiving the synthesized spectrum and providing a perceptually weighted prediction to the subtractor 30, the residual signal output of which is provided to the excitation codebook 20. Both the excitation signal codeword $C_i$ and the gain term G are updated three times per frame.

The gain term G is quantized by coding circuit 32 using a 5-bit scalar quantizer. The excitation codebook is populated by a decomposed multipulse signal, described in more detail below. Two excitation codebook structures can be employed. One is a non-expanded codebook with a full-search procedure to select the best excitation codeword. The other is an expanded codebook with a two-step procedure to select the best excitation codeword. Depending on the codebook structure used, different numbers of data bits are allocated for the excitation signal coding.

To further improve the speech quality, two additional techniques may be used for coding and analysis. The first is a dynamic bit allocation scheme which reallocates data bits saved from insignificant pitch filters (and/or excitation signals) to some excitation signals which are in need of them, and the second is an iterative scheme which jointly optimizes the speech codec parameters. The optimization procedure requires an iterative recomputation of the spectrum filter coefficients, the pitch filter parameters, the excitation gain and the excitation signal, all as described in more detail below.

Figure 2:
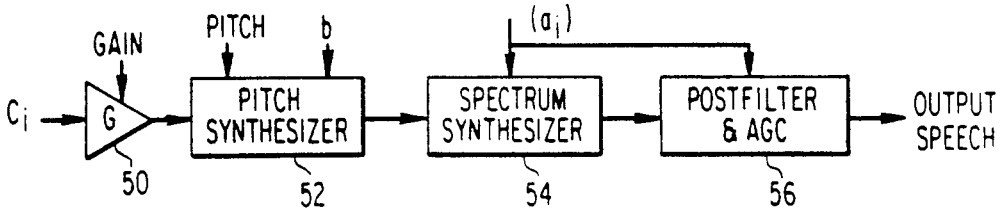
FIG. 2 is a block diagram of the decoder portion of an analysis-by-synthesis speech codec.

At the decoding side briefly shown in FIG. 2, the selected excitation codeword $C_i$ is multiplied by the gain term G in amplifier 50 and is then used as the input signal to the pitch synthesizer 54 the output of which is used as an input to spectrum synthesizer 56. At 4.8 kbps, a post-filter 56 is necessary to enhance the perceived quality of the reconstructed speech. An automatic gain control scheme is also used to ensure the speech power before and after the post-filter are approximately the same. Suitable algorithms for post-filtering and automatic gain control are described in more detail below.

Depending on the use of the expanded or non-expanded excitation codebooks, several different bit allocation schemes result, as shown in the following Table 1.

| Codec | #1 | #2 |
|---|---|---|
| Sample Rate | 8 kHz | 8 kHz |
| Frame Size (samples) | 210 | 180 |
| Bits Available | 126 | 108 |
| Spectrum Filter | 26 | 26 |
| Pitch | 21 | 21 |
| Pitch Gain | 15 | 15 |
| Excitation Gain | 15 | 15 |
| Excitation | 45 | 27 |

-continued

| Codec | #1 | #2 |
|---|---|---|
| Frame Sync | 1 | 1 |
| Remaining Bits | 3 | 3 |

Generally, the codecs with the non-expanded excitation codebook have somewhat worse performance. However, they are easier to implement in hardware. It is noted here that other bit allocation schemes can still be derived based on the same structure. However, their performance will be very close.

Speech Activity Detection

In most practical situations, the speech signal contains noise of a level which varies over time. As noise level increases, the task of precisely determining the onset and ending of speech becomes more difficult, and the speech activity detection becomes more difficult. The speech activity detection algorithm preferred herein is based on comparing the frame energy E of each frame to a noise energy threshold $N_{th}$. In addition, the noise energy threshold is updated at each frame so that any variations in the noise level can be tracked.

Figure 3:
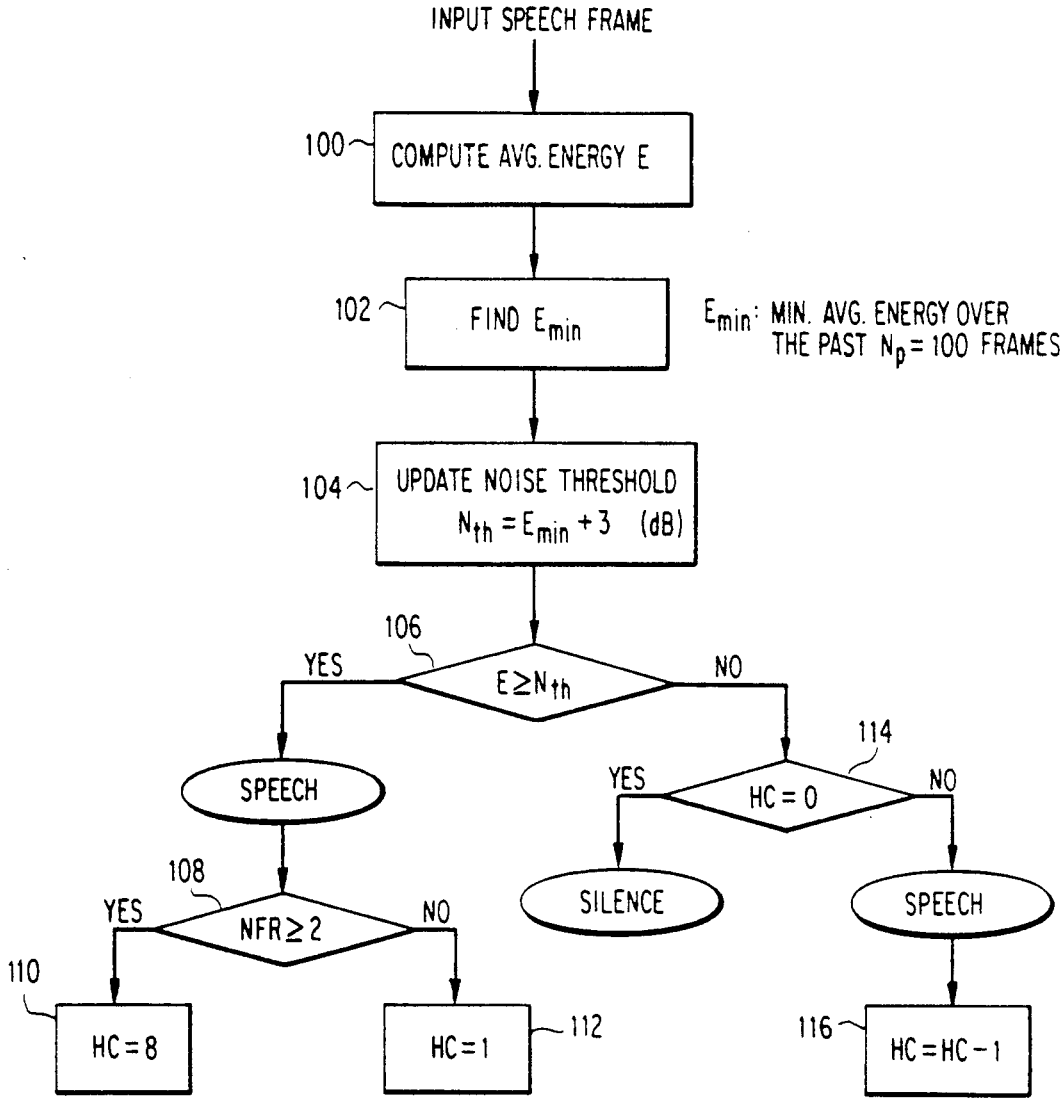
FIG. 3 is a flow chart illustrating speech activity detection according to the present invention.

A flow chart of the speech activity detection algorithm is shown in FIG. 3. The average energy E is computed at 100, and the minimum energy is determined over the interval $N_p = 100$ frames at step 102. The noise threshold is then set at a value of 3 dB above $E_{min}$ at step 104.

The statistics of the length of speech spurts are used in determining the window length ($N_p = 100$ frames) for adaptation of $N_{th}$. The average length of a speech spurt is about 1.3 sec. A 100-frame window corresponds to more than 2 sec, and hence, there is a high probability that the window contains some frames which are purely silence or noise.

The energy E is compared at step 106 with the threshold $N_{th}$ to determine if the signal is silence or speech. If it is speech, step 108 determines if the number of consecutive speech frames immediately preceding the present frame (i.e., "NFR") is greater than or equal to 2. If so, a hangover count is set to a value of 8 at step 110. If NFR is not greater than or equal to 2, the hangover count is set to a value of 1 at step 112.

If the energy level E does not exceed the threshold at step 106, the hangover count is examined at step 114 to see if it is at 0. If not, then there is not yet a detected speech condition and the hangover count is decremented at step 116. This continues until the hangover count is decremented to 0 from whatever value it was last set at in steps 110 or 112, and when step 114 detects that the hangover count is 0, silence detection has occurred.

The hangover mechanism has two functions. First, it bridges over the intersyllabic pauses that occur within a speech spurt. The choice of eight frames is governed by the statistics pertaining to the duration of the intersyllabic pauses. Second, it prevents clipping of speech at the end of a speech spurt, where the energy decays gradually to the silence level. The shorter hangover period of one frame, before the frame energy has risen and stayed above the threshold for at least three frames, is to prevent false speech declaration due to short bursts of impulsive noise.

Spectrum Filter Coding

Figure 4A:
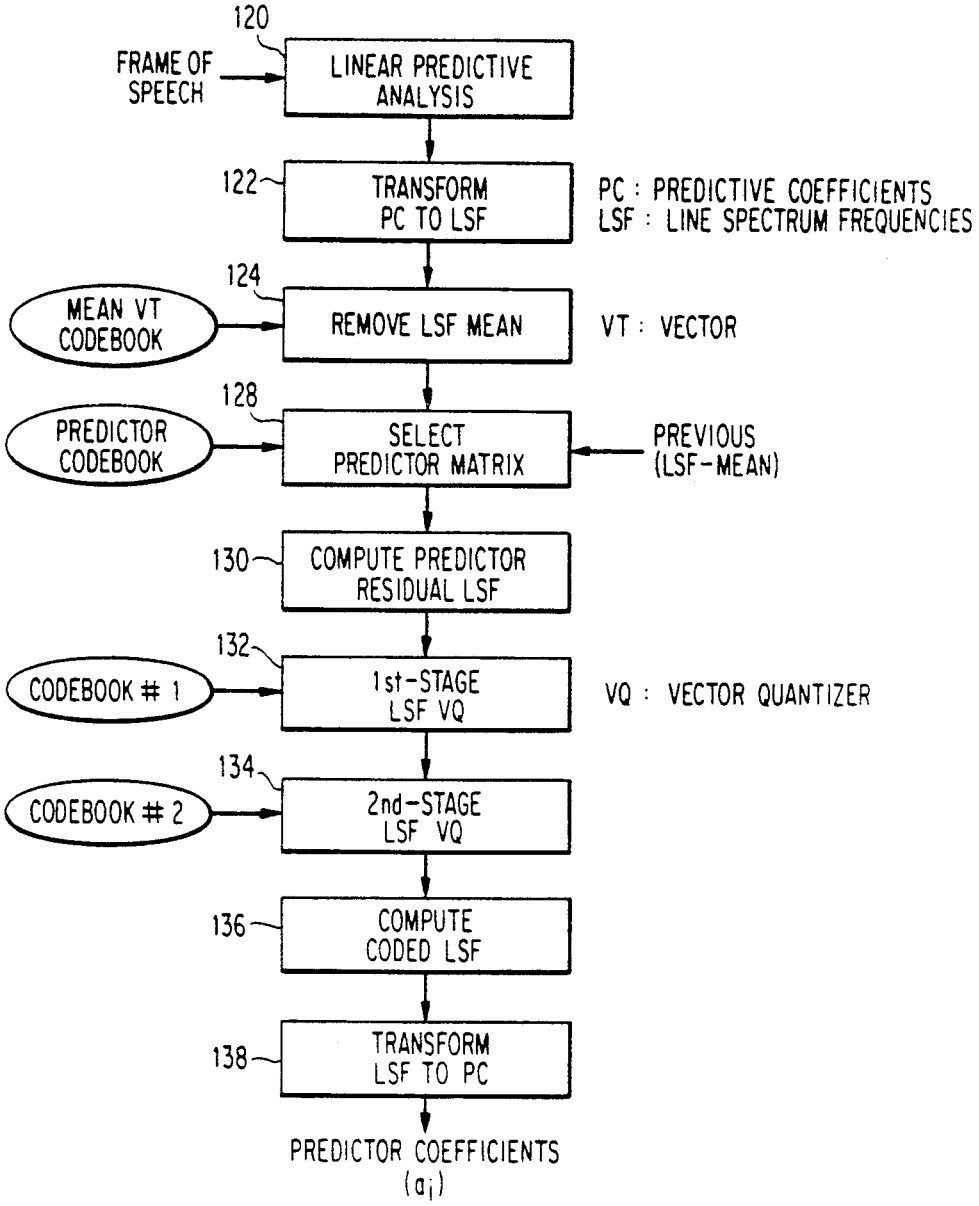
FIG. 4(*a*) is a flow chart illustrating an interframe predictive coding scheme according to the present invention.
Figure 4B:
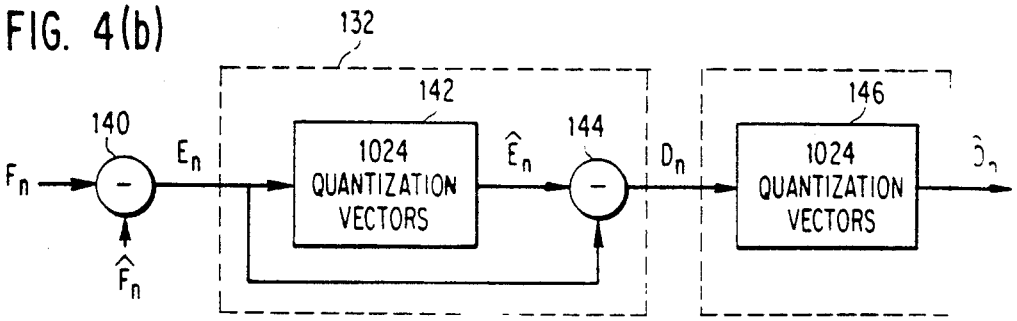

Based on the observation that the spectral shapes of two consecutive frames of speech are very similar, and the fact that the number of possible vocal tract configurations is not unlimited, an interframe predictive scheme with vector quantization can be used for spectrum filter coding. The flow chart of this scheme is shown in FIG. 4(*a*).

The interframe predictive coding scheme can be formulated as follows. Given the parameter set of the current frame, $F_n=(f_n^{(1)}, f_n^{(2)}, \ldots, f_n^{(10)})^T$ for a 10th order spectrum filter, the predicted parameter set is $$\hat{F}_n = AF_{n-1} \quad (1)$$

where the optimal prediction matrix A, which minimizes the mean squared prediction error, is given by $$A=[E(F_nF_{n-1}^T)][E(F_{n-1}F_{n-1}^T)]^{-1} \quad (2)$$

where E is the expectation operator.

Because of their smooth behavior from frame to frame, the line-spectrum frequencies (LSF), described, e.g. by G. S. Kang and L. J. Fransen, "Low-Bit-Rate Speech Encoders Based on Line-Spectrum Frequencies (LSFs)", NRL Report 8857, November, 1984, are chosen as the parameter set. For each frame of speech, a linear predictive analysis is performed at step 120 to extract ten predictor coefficients (PCs). These coefficients are then transformed into the corresponding LSF parameters at step 122. For interframe prediction, a mean LSF vector, which is precomputed using a large speech data base, is first subtracted from the LSF vector of the current frame at step 124. A 6-bit codebook of (10×10) prediction matrices, which is also precomputed using the same speech data base, is exhaustively searched at step 128 to find the prediction matrix A which minimizes the mean squared prediction error at step 128.

The predicted LSF vector $\hat{F}_n$ for the current frame is then computed at step 130, as well as the residual LSF vector which results from the difference between the current frame LSF vector $F_n$ and the predicted LSF vector $\hat{F}_n$. The residual LSF vector is then quantized by a 2-stage vector quantizer at steps 132 and 134. Each vector quantizer contains 1024 (10-bit) vectors. For improved performance, a weighted mean-squared-error distortion measure based on the spectral sensitivity of each LSF parameter and human listening sensitivity factors can be used. Alternatively, it has been found that a simple weighting vector [2, 2, 1, 1, 1, 1, 1, 1, 1, 1,], which gives twice weight to the first two LSF parameters, may be adequate.

The 26-bit coding scheme may be better understood with reference to FIG. 4(*b*). Having selected the predictor matrix A at step 128, the predicted LSF vector $\hat{F}_n$ can be computed at step 130 in accordance with Eq. (1) above. Subtracting the predicted LSF vector $\hat{F}_n$ from the actual LSF vector $F_n$ in a subtractor 140 then yields the residual LSF vector labelled as $E_n$ in FIG. 4(*b*). The residual vector $E_n$ is then provided to first stage quantizer 142 which contains 1024 (10-bit) vectors from which is selected the (10-bit) vector closest to the residual LSF vector $E_n$. The selected vector is designated in FIG. 4(*b*) as $\hat{E}_n$, and is provided to a subtractor 144 for calculation of a second residual vector $D_n$ representing the difference between the first residual signal $E_n$ and its approximation $\hat{E}_n$. The second residual signal $D_n$ is then provided to a second stage quantizer 146 which, like the first stage quantizer 142, contains 1024 (10-bit) vectors from which is selected the vector closest to the second residual signal $D_n$. The vector selected by the second stage quantizer 146 is designated as $\hat{D}_n$ in FIG. 4(*b*).

To decode the current LSF vector, the decoder will need to know $\hat{D}_n$, $\hat{E}_n$ and $\hat{F}_n$. $\hat{D}_n$ and $E_n$ are each 10-bit vectors, for a total of 20 bits. $\hat{F}_n$ can be obtained from $F_{n-1}$ and A according to Eq. (1) above. Since $F_{n-1}$ is already available at the decoder, only the 6-bit code representing the matrix selected at step 128 is needed, thus a total of 26 bits.

The coded LSF values are then computed at step 136 through a series of reverse operations. They are then transformed at step 138 back to the predictor coefficients for the spectrum filter.

For spectrum filter coding, several codebooks have to be pre-computed using a large training speech data base. These codebooks include the LSF mean vector codebook as well as the two codebooks for the two-stage vector quantizer. The entire process involves a series of steps where each step would use the data from the previous step to generate the desired codebook for this step, and generate the required data base for the next step. Compared to the 41-bit coding scheme used in LPC-10, the coding complexity is much higher, but the data compression is significant.

To improve the coding performance, a perceptual weighting factor may be included in the distortion measure used for the two-stage vector quantizer. The distortion measure is defined as $$D = \sum_{i=1}^{10} \omega_i(X_i - \gamma_i)^2$$

where $X_i$, $\gamma_i$ denote respectively, the component of the LSF vector to be quantized and the corresponding component of each codeword in the codebook. $\omega$ is the corresponding perceptual weighting factor, and is defined as $$\omega_i = \begin{cases} u(f_i)\sqrt{D_i/D_{max}} & 1.375 \leqq D_i \leqq D_{max} \\ u(f_i)\sqrt{D_i/1.375D_{max}} & D_i < 1.375 \end{cases}$$

where $$u(f_i) = \begin{cases} 1 & 1.375 < f_i < 1000 \text{ Hz} \\ \frac{-0.5}{3000}(f_i - 1000) + 1 & 1000 \leqq f_i \leqq 4000 \text{ Hz} \end{cases}$$

$u(f_i)$ is a factor which accounts for the human ear insensitivity to the high frequency quantization inaccuracy. $f_i$ denotes the ith component of the line-spectrum frequencies for the current frame. $D_i$ denotes the group delay for $f_i$ in milliseconds. $D_{max}$ is the maximum group delay which has been found experimentally to be around 20 ms. The group delays $D_i$ account for the specific spectral sensitivity of each frequency $f_i$, and are well related to the formant structure of the speech spectrum. At frequencies near the formant region, the group delays are larger. Hence those frequencies should be more accurately quantized, and hence the weighting factors should be larger.

The group delays $D_i$ can be easily computed as the gradient of the phase angles of the ratio filter at $-n\pi$ ($n=1, 2, \ldots, 10$). These phase angles are computed in the process of transforming predictor coefficients of the spectrum filter to the corresponding line-spectrum frequencies.

Due to the block processing nature in the computation of the spectrum filter parameters in each frame, the spectrum filter parameters can have abrupt change in neighboring frames during transition periods of the speech signal. To smooth out the abrupt change, a spectrum filter interpolation scheme may be used.

The quantized line-spectrum frequencies (LSF) are used for interpolation. To synchronize with the pitch filter and excitation computation, the spectrum filter parameters in each frame are interpolated into three different sets of values. For the first one-third of the speech frame, the new spectrum filter parameters are computed by a linear interpolation between the LSFs in this frame and the previous frame. For the middle one-third of the speech frame, the spectrum filter parameters do not change. For the last one-third of the speech frame, the new spectrum filter parameters are computed by a linear interpolation between the LSFs in this frame and the following frame. Since the quantized line-spectrum frequencies are used for interpolation, no extra side information is needed to be transmitted to the decoder.

For spectrum filter stability control, the magnitude ordering of the quantized line-spectrum frequencies ($f_1, f_2, \ldots, f_{10}$) is checked before transforming them back to the predictor coefficients. If any magnitude ordering is violated, i.e., $f_i < f_{i-1}$, the two frequencies are interchanged.

An alternative 36-bit coding scheme is based on a method proposed by F. K. Soong and B. Juang, "Line-Spectrum Pair (LSP) and Speech Data Compression", IEEE Proc. ICASSP-84, pp. 1.10.1-1.10.4. Basically, the ten predictor coefficients are first converted to the corresponding line spectrum frequencies, denoted as ($f_1, \ldots, f_{10}$). The quantizing procedure is then:

(1) Quantize $f_1$ to $\hat{f}_1$, and set $i=1$,
(2) Calculate $\Delta f_i = f_{i+1} - \hat{f}_i$
(3) Quantize $\Delta f_i$ to $\Delta\hat{f}_i$
(4) Reconstruct $f_{i+1} = \hat{f}_i + \Delta\hat{f}_i$
(5) If $i=10$, stop; otherwise, go to (2)

Because the lower order line spectrum frequencies have higher spectral sensitivities, more data bits should be allocated to them. It is found that a bit allocation scheme which assigns 4 bits to each of $\Delta f_1 - \Delta f_6$, and 3 bits to each of $\Delta f_7 - \Delta f_{10}$, is enough to maintain the spectral accuracy. This method requires more data bits. However, since only scalar quantizers are used, it is much simpler in terms of hardware implementation.

Pitch and Pitch Gain Computation

The following is a description of two methods for better pitch-loop tracking to improve the performance of CELP speech coders operating at 4.8 kbps. The first method is to use a closed-loop pitch filter analysis method. The second method is to increase the update frequency of the pitch filter parameters. Computer simulation and informal listening test results have indicated that significant improvement in the reconstructed speech quality is achieved.

It is also apparent from the discussion below that the closed-loop method for best excitation codeword selection is essentially the same as the closed-loop method for pitch filter analysis.

Before elaborating on the closed-loop method for pitch filter analysis, an open-loop method will be described. The open-loop pitch filter analysis is based on the residual signal $\{e_n\}$ from short-term filtering. Typically, a first-order or a third-order pitch filter is used. Here, for performance comparison with the closed-loop scheme, a first-order pitch filter is used. The pitch period M (in terms of number of samples) and the pitch filter coefficient b are determined by minimizing the prediction residual energy E(M) defined as $$E(M) = \sum_{n=1}^{N} (e_n - be_{n-M})^2 \tag{3}$$

wherein N is the analysis frame length for pitch prediction. For simplicity, a sequential procedure is usually used to solve for the values M and b for a minimum E(M). The value b is derived as $$b = R_M / R_o \tag{4}$$

where $$R_M = \sum_{n=1}^{N} e_n e_{n-M}, \text{ and } R_o = \sum_{n=1}^{N} e_{n-M}^2 \tag{5}$$

Substituting b in (4) into (3), it is easy to show that minimizing E(M) is equivalent to maximizing $R_M^2/R_o$. This term is computed for each value of M in a selected range from 16 to 143 samples. The M value which maximizes the term is selected as the pitch value. The pitch filter coefficient b is then computed from equation (4).

The closed-loop pitch filter analysis method was first proposed by S. Singhal and B. S. Atal, "Improving Performance of Multipulse LPC Coders at Low Bit Rates", proc. ICASSP, pp. 1.3.1-1.3.4, 1984, for multipulse analysis with pitch prediction. However, it is also directly applicable to CELP coders. This method for pitch filter analysis is such that the pitch value and the pitch filter parameters are determined by minimizing a weighted distortion measure (typically MSE) between the original and the reconstructed speech. Likewise, the closed-loop method for excitation search is such that the best excitation signal is determined by minimizing a weighted distortion measure between the original and the reconstructed speech.

Figure 5:
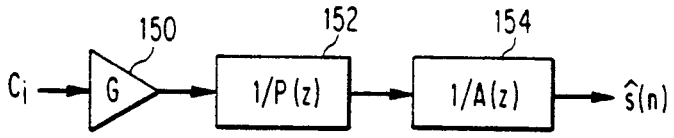
FIG. 5 is a block diagram of a CELP synthesizer.

A CELP synthesizer is shown in FIG. 5, where C is the selected excitation codeword, G is the gain term represented by amplifier 150 and 1/P(Z) and 1/A(Z) represent the pitch synthesizer 152 and the spectrum synthesizer 154, respectively. For closed-loop analysis, the objective is to determine the codeword $C_i$, the gain term G, the pitch value M and the pitch filter parameters so that the synthesized speech $\hat{S}(n)$ is closest to the original speech S(n) in terms of a defined weighted distortion measure (e.g., MSE).

Figure 6:
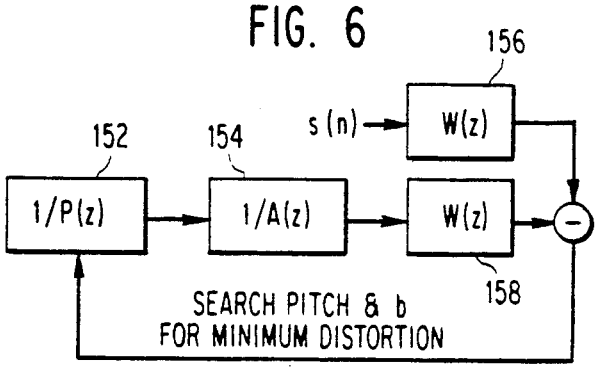
FIG. 6 is a block diagram illustrating a closed-loop pitch filter analysis procedure according to the present invention.

A closed-loop pitch filter analysis procedure is shown in FIG. 6. The input signal to the pitch synthesizer 152 (e.g., which would otherwise be received from the left side of the pitch filter 152) is assumed to be zero. For simplicity in computation, a first-order pitch filter, $P(Z) = 1 - bZ^{-M}$, is used. The spectral weighting filters 156 and 158 have a transfer function given by $$W(z) = \frac{A(Z)}{A(Z/\gamma)} \tag{6a}$$

where $$A(Z) = 1 + \sum_{i=1}^{10} a_i Z^{-i} \tag{6b}$$

$\gamma$ is a constant for spectral weighting control. Typically, $\gamma$ is chosen around 0.8 for a speech signal sampled at 8 kHz.

Figure 7:
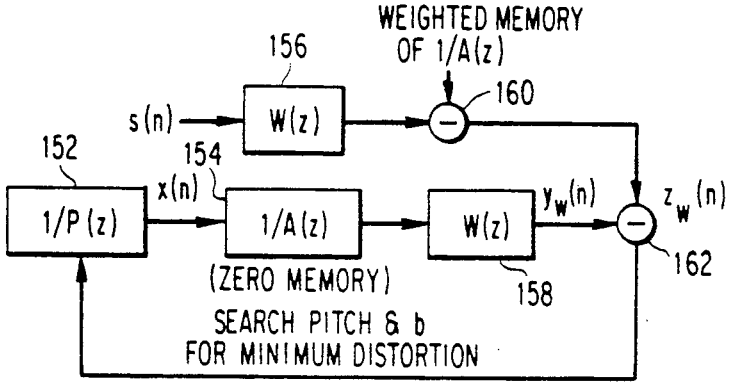
FIG. 7 is an equivalent block diagram of FIG. 6.

An equivalent block diagram of FIG. 6 is given in FIG. 7. For zero input, $\chi(n)$ is given by $\chi(n)=b\chi(n-M)$. Let $Y_W(n)$ be the response of the filters 154 and 158 to the input $\chi(n)$, then $Y_W(n)=bY_W(n-M)$. The pitch value M and the pitch filter coefficient b are determined so that the distortion between $Y_W(n)$ and $Z_W(n)$ is minimized. Here, $Z_W(n)$ is defined as the residual signal after the weighted memory of filter A(Z) has been subtracted from the weighted speech signal in subtractor 160. $Y_W(n)$ is then subtracted from $Z_W(n)$ in subtractor 162, and the distortion measure between $Y_W(n)$ and $Z_W(n)$ is defined as:

$$E_W(M, b) = \sum_{n=1}^{N} (Z_W(n) - Y_W(n))^2 = \sum_{n=1}^{N} (Z_W(n) - bY_W(n-M))^2 \tag{7}$$

where N is the analysis frame. For optimum performance, the pitch value M and the pitch filter coefficient b should be searched simultaneously for a minimum $E_W(M,b)$. However, it is found that a simple sequential solution of M and b does not introduce significant performance degradation. The optimum value of b is given by $$b = \frac{\sum_{n=1}^{N} Z_W(n)Y_W(n-M)}{\sum_{n=1}^{N} Y_W^2(n-M)} \tag{8}$$

and the minimum value of $E_W(M,b)$ is given by $$E_W(M) = \sum_{n=1}^{N} Z_W^2(n) - \frac{\left(\sum_{n=1}^{N} (Z_W(n)Y_W(n-M))\right)^2}{\sum_{n=1}^{N} Y_W^2(n-M)} \tag{9}$$

Since the first term is fixed, minimizing $E_W(M)$ is equivalent to maximizing the second term. This term is computed for each value of M in the given range (16–143 samples) and the value which maximizes the term is chosen as the pitch value. The pitch filter coefficient b is then found from equation (8).

For a first order pitch filter, there are two parameters to be quantized. One is the pitch itself. The other is the pitch gain. The pitch is quantized directly using 7 bits for a pitch range from 16 to 143 samples. The pitch gain is scalarly quantized by using 5 bits. The 5-bit quantizer is designed using the same clustering method as in a vector quantizer design. That is, a training data base of the pitch gain is gathered by running a large speech data base through the encoding process, and the same method used in designing a vector quantizer codebook is then used to generate the codebook for the pitch gain. It has been found that 5 bits are enough to maintain the accuracy of the pitch gain.

It has also been found that the pitch filter may sometimes become unstable, especially in the transition period where the speech signal changes its power level abruptly (e.g., from silent frame to voiced frame). A simple method to assure the filter stability is to limit the pitch gain to a pre-determined threshold value (e.g., 1.4). This constraint is imposed in the process of generating the training data base for the pitch gain. Hence the resultant pitch gain codebook does not contain any value larger than the threshold. It has been found that the coder performance was not affected by this constraint.

Figure 8:
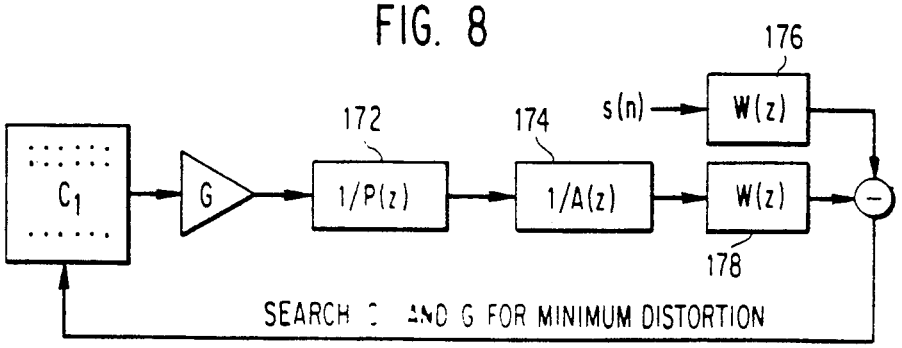
FIG. 8 is a block diagram illustrating a closed-loop excitation codeword search procedure according to the present invention.

The closed-loop method for searching the best excitation codeword is very similar to the closed-loop method for pitch filter analysis. A block diagram for the closed-loop excitation codeword search is shown in FIG. 8, with an equivalent block diagram being shown in FIG. 9. The distortion measure between $Z_W(n)$ and $Y_W(n)$ is defined as $$E_W(G, C_i) = \sum_{n=1}^{N} (Z_W(n) - GY_W(n))^2 \tag{10}$$

where $Z_W(n)$ denotes the residual signal after the weighted memories of filters 172 and 174 have been subtracted from the weighted speech signal in subtractor 180. $Y_W(n)$ denotes the response of the filters 172, 174 and 178 to the input signal $C_i$, where $C_i$ is the codeword being considered.

As in the closed-loop pitch filter analysis, a suboptimum sequential procedure is used to find the best combination of G and $C_i$ to minimize $E_W(G,C_i)$. The optimum value of G is given by $$G = \frac{\sum_{n=1}^{N} Z_W(n)Y_W(n)}{\sum_{n=1}^{N} Y_W^2(n)} \tag{11}$$

and the minimum value of $E_W(G,C_i)$ is given by $$E_W(C_i) = \sum_{n=1}^{N} Z_W^2(n) - \frac{\left(\sum_{n=1}^{N} Z_W(n)Y_W(n)\right)^2}{\sum_{n=1}^{N} Y_W^2(n)} \tag{12}$$

As before, minimizing $E_W(C_i)$ is equivalent to maximizing the second term in equation (12). This term is computed for each codeword $C_i$ in the excitation codebook. The codeword $C_i$ which maximizes the term is selected as the best excitation codeword. The gain term G is then computed from equation (11).

The quantization of the excitation gain is similar to the quantization of the pitch gain. That is, a training data base of the excitation gain is gathered by running a large speech data base through the encoding process, and the same method used in designing a vector quantizer codebook is used to generate the codebook for the excitation gain. It has been found that 5 bits were enough to maintain the speech coder performance.

In M. R. Schroeder and B. S. Atal, "Code-Excited Linear Prediction (CELP): High Quality Speech at Very Low Bit Rates", proc. Int. Conf. Acoust., Speech, and Signal Processing (ICASSP), pp. 937–940, 1985, it has been demonstrated that high quality speech can be obtained using a CELP coder. However, in that scheme, all the parameters to be transmitted, except the excitation codebook (a 10-bit random Gaussian codebook), are left uncoded. Also, the parameter update frequencies are assumed to be high. Specifically, the (16th-order) short-term filter is updated once per 10 ms. The long-term filter is updated once per 5 ms. For CELP speech coding at 4.8 kbps, there are not enough data bits for the short-term filter to be updated more than once per frame (about 20–30 ms). However, with appropriate system design, it is possible to update the long-term filter more than once per frame.

Computer simulation and informal listening tests have been conducted by the present inventor for CELP coders employing open-loop or closed-loop pitch filter analysis with different pitch filter update frequencies. The coders are denoted as follows:

| | |
|---|---|
| CP1A: | open-loop, one update. |
| CP1B: | closed-loop, one update. |
| CP4A: | open-loop, four updates. |
| CP4B: | closed-loop, four updates. |

Figure 10:
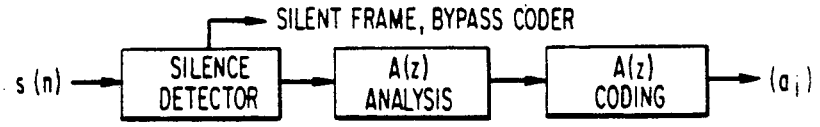
FIGS. 10(*a*)–10(*d*) collectively illustrate a CELP coder according to the present invention.
Figure 10:
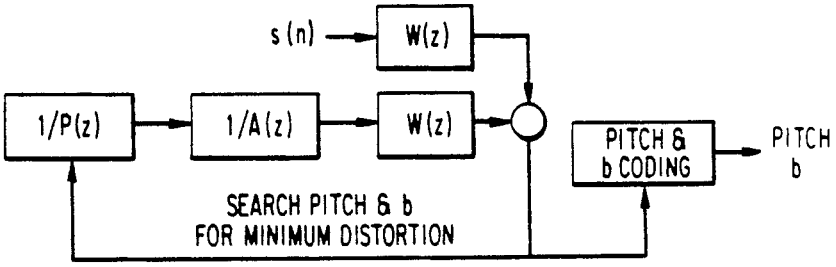
Figure 10:
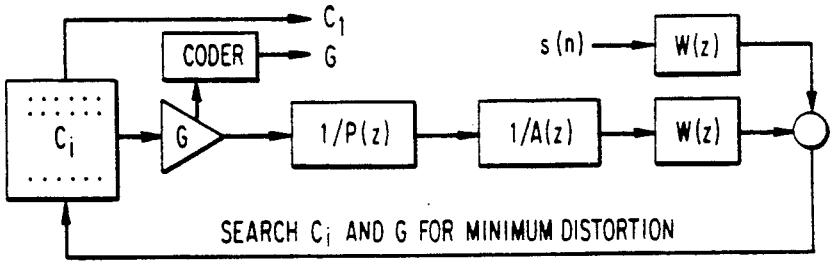
Figure 10:
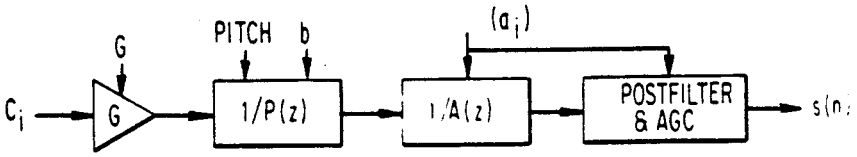

A block diagram of the CELP coder is shown in FIGS. 10(*a*)–10(*c*), and the decoder in FIG. 10(*d*), with the pitch and pitch gain being determined by a closed loop method as shown in FIG. 6 and the excitation codeword search being performed by a closed loop method as shown in FIG. 8. The bit allocation schemes for the four coders are listed in the following Table.

| Codec | CP1A, CP1B | CP4A, CP4B |
|---|---|---|
| Sample Rate | 8 kHz | 8 kHz |
| Frame Size | 168 samples | 220 samples |
| Bits Available | 100 | 132 |
| A(Z) | 24 | 24 |
| Pitch | 7 | 28 |
| b | 5 | 20 |
| Gain | 24 | 24 |
| Excitation | 40 | 36 |

For short-term filter analysis, the autocorrelation method is chosen over the covariance method for three reasons. The first is that by listening tests, there is no noticeable difference in the two methods. The second is that the autocorrelation method does not have a filter stability problem. The third is that the autocorrelation method can be implemented using fixed-point arithmetic. The ten filter coefficients, in terms of the line spectrum frequencies, are encoded using a 24-bit interframe predictive scheme with a 20-bit 2-stage vector quantizer (the same as the 26-bit scheme described above except that only 4 bits are used to designate the matrix A), or a 36-bit scheme using scalar quantizers as described above. However, to accommodate the increased bits, the speech frame size has to be increased.

The pitch value and the pitch filter coefficient were encoded using 7 bits and 5 bits, respectively. The gain term and the excitation signal were updated four times per frame. Each gain term was encoded using 6 bits. The excitation codebook was populated using decomposed multipulse signals as described below. A 10-bit excitation codebook was used for CP1A and CP1B coders, and a 9-bit excitation codebook was used for CP4A and CP4B coders.

The CP1A, CP1B coders were first compared using informal listening tests. It was found that the CP1B coder did not sound better than the CP1A coder. The pitch filter update frequency is different from the excitation (and gain) update frequency, so that the pitch filter memory used in searching the best excitation signal is different from the pitch filter memory used in the closed-loop pitch filter analysis. As a result, the benefit gained by using a closed-loop pitch filter analysis is lost.

Figure 11:
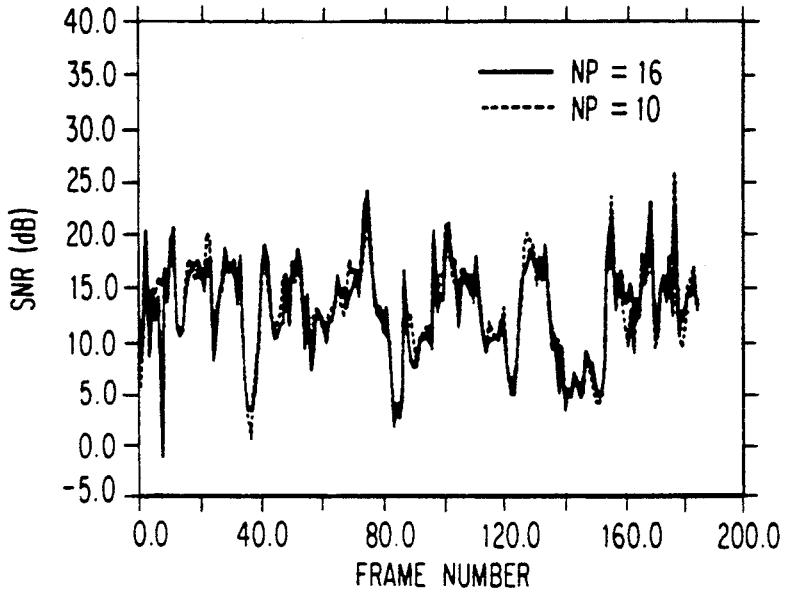
FIG. 11 is an illustration of the frame signal-to-noise ratio (SNR) for a coder employing closed-loop pitch filter analysis with a pitch filter update frequency of four times per frame.

The CP4A and CP4B coders clearly avoided this problem. Since the frame size is larger in this case, an attempt was made to determine if using more pulses in the decomposed multipulse excitation model would improve the coder performance. Two values of $N_p$ ($N_p$=16,10) were tried, where $N_p$ is the number of pulses in each excitation codeword. The simulation result, in terms of the frame SNR, is shown in FIG. 11. It is seen that increasing $N_p$ beyond 10 does not improve the coder performance in this case. Hence, $N_p$=10 was chosen.

Figure 12:
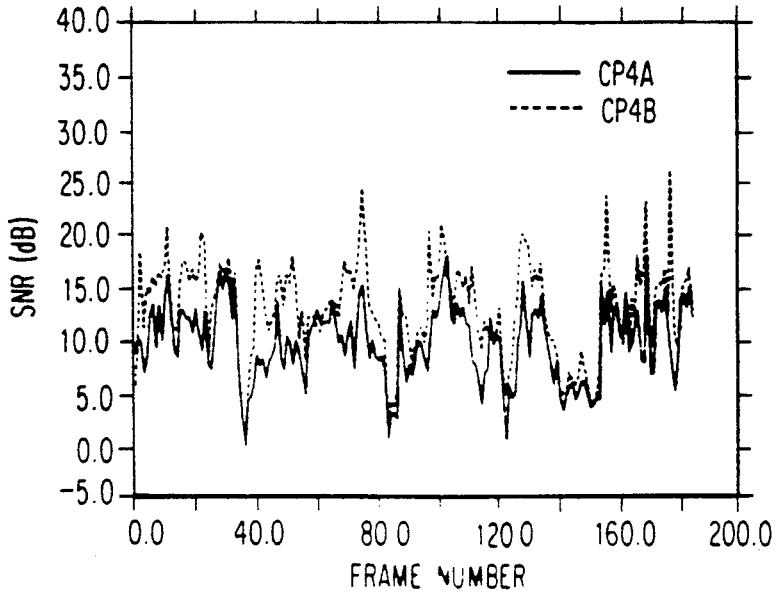
FIG. 12 is an illustration of the frame SNR for coders having a pitch filter update frequency of four times per frame, one coder using an open-loop pitch filter analysis and another using a closed-loop pitch filter analysis.
Figure 13:
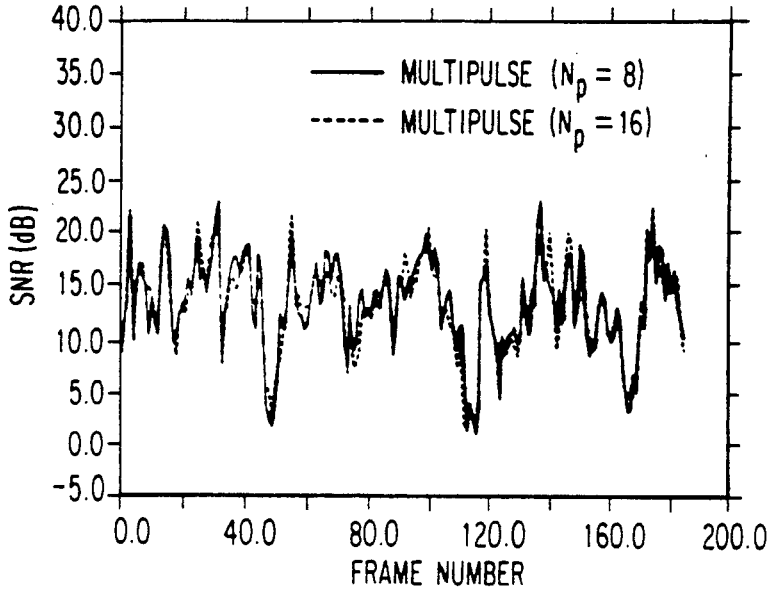
FIG. 13 illustrates the frame SNR for a coder employing multipulse excitation, for different values of $N_p$ where $N_p$ is the number of pulses in each excitation code word.
Figure 14:
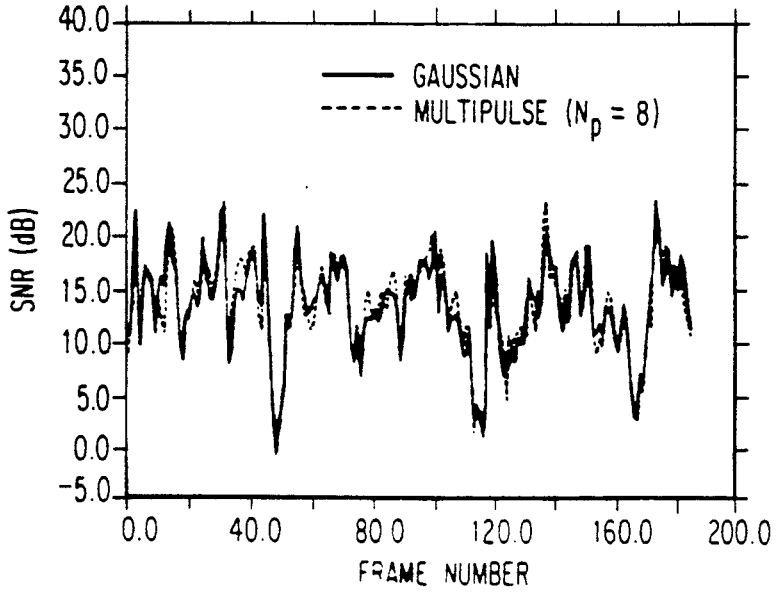
FIG. 14 illustrates the frame SNR for a coder using a codebook populated by Gaussian numbers and another coder using a codebook populated by multipulse vectors.
Figure 15:
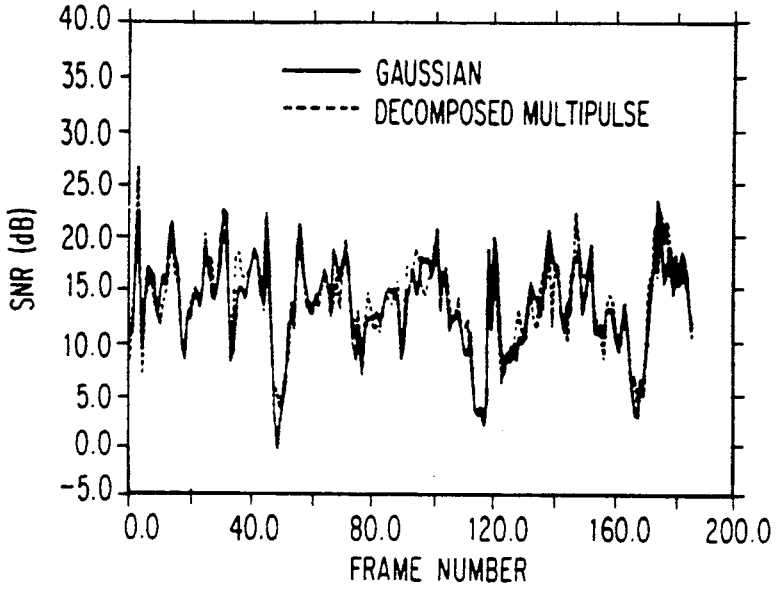
FIG. 15 illustrates the frame SNR for a coder using a codebook populated by Gaussian numbers and another coder using a codebook populated by decomposed multipulse vectors.
Figure 16:
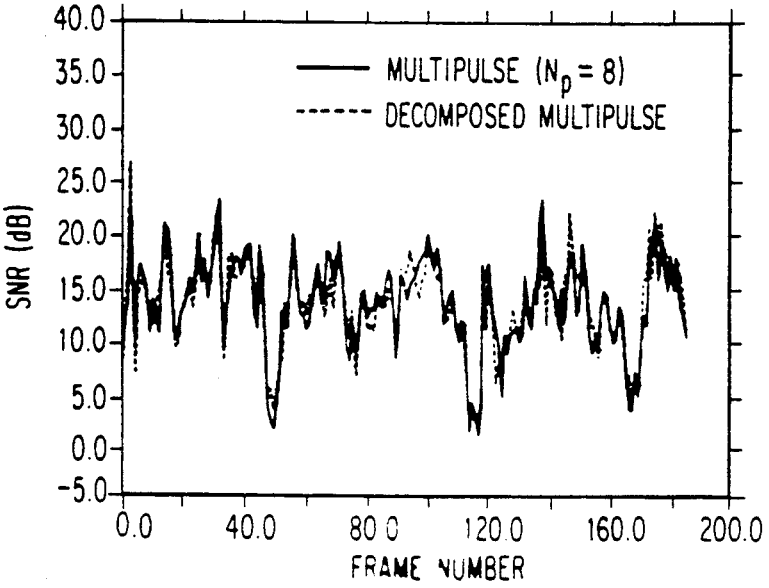
FIG. 16 illustrates the frame SNR for a coder using a codebook populated by multipulse vectors and another coder using a codebook populated by decomposed multipulse vectors.

A comparison of the performance for the CP4A and CP4B coders, in terms of the frame SNR, is shown in FIG. 12. It can be seen that the closed-loop scheme provides much better performance than the open-loop scheme. Although SNR does not correlate well with the perceived coder quality, especially when perceptual weighting is used in the coder design, it is found that in this case the SNR curve provides a correct indication. From informal listening tests, it was found that the CP4B coder sounded much smoother and cleaner than any of the remaining three coders. The reconstructed speech quality was actually regarded as close to "near-toll".

Multipulse Decomposition

P. Kroon and B. S. Atal, "Quantization Procedures for the Excitation in CELP Coders", proc. ICASSP, pp. 38.8–38.11, 1987, have demonstrated that in a CELP coder, the method of populating an excitation codebook does not make a significant difference. Specifically, it was shown that for a 1024-codeword codebook populated by different members, one by random Gaussian numbers, one by random uniform numbers, and one by multipulse vectors, the reproduced speech sounds almost identical. Due to the sparsity characteristic (many zero terms) of a multipulse excitation vector, it serves as a good candidate excitation model for memory reduction.

The following is a description of a proposed excitation model to replace the random Gaussian excitation model used in the prior art, to achieve a significant reduction in memory requirement without sacrifice in performance. Suppose there are $N_f$ samples in an excitation sub-frame, so that the memory requirement for a B-bit Gaussian codebook is $2^B \times N_f$ words. Assuming $N_p$ pulses in each multipulse excitation codeword, the memory requirement, including pulse amplitudes and positions, is $(2^B \times 2 \times N_p)$ words. Generally, $N_p$ is much smaller than $N_f$. Hence, a memory reduction is achieved by using the multipulse excitation model.

To further reduce the memory requirement, a decomposed multipulse excitation model is proposed. Instead of using $2^B$ multipulse codewords directly with the pulse amplitudes and positions randomly generated, $2^{B/2}$ multipulse amplitude codewords and $2^{B/2}$ multipulse position codewords are separately generated. Each multipulse excitation codeword is then formed by using one of the $2^{B/2}$ multipulse amplitude codewords and one of the $2^{B/2}$ multipulse position codewords. A total of 2B different combinations can be formed. The size of the codebook is identical. However, in this case, the memory requirement is only $(2\times2^{B/2})\times N_p$ words.

To demonstrate that the decomposed multipulse excitation model is indeed a valid excitation model, computer simulation was performed to compare the coder performance using the three different excitation models, i.e., the random Gaussian model, the random multipulse model, and the decomposed multipulse excitation model. The Gaussian codebook was generated by using an N(0,1) Gaussian random number generator. The multipulse codebook was generated by using a uniform and a Gaussian random number generator for pulse positions and amplitudes, respectively. The decomposed multipulse codebook was generated in the same way as the multipulse codebook.

The size of a speech frame was set at 160 samples, which corresponds to an interval of 20 ms for a speech signal sampled at 8 kHz. A 10th-order short-term filter and a 3rd-order long-term filter were used. Both filters and the pitch value were updated once per frame. Each speech frame was divided into four excitation subframes. A 1024-codeword codebook was used for excitation.

For the random multipulse model, two values of $N_p$(8 and 16) were tried. It was found that, in this case, $N_p=8$ is as good as $N_p=16$. Hence, $N_p=8$ was chosen. The memory requirement for the three models is as follows:

| | |
|---|---|
| Gaussian excitation: | 1024 × 40 = 40960 words |
| Multipulse excitation: | 1024 × 2 × 8 = 16384 words |
| Decomposed multipulse excitation: | (32 + 32) × 8 = 512 words |

It is obvious that the memory reduction is significant. On the other hand, the coder performance, by using different excitation models, as shown in FIGS. 13–16, are virtually identical. Thus, multipulse decomposition represents a very simple but effective excitation model for reducing the memory requirement for CELP excitation codebooks. It has been verified through computer simulation that the new excitation model is equally effective as the random Gaussian excitation model for a CELP coder.

It is to be noted that, with this excitation model, the size of the codebook can be expanded to improve the coder performance without having the problem of memory overload. However, a corresponding fast search method to find the best excitation codeword from the expanded codebook would then be needed to solve the computational complexity problem.

Multipulse Excitation Codebook Using Direct Vector Quantization

1. Multipulse Vector Generation

The following is a description of a simple, effective method for applying vector quantization directly to multipulse excitation coding. The key idea is to treat the multipulse vector, with its pulse amplitudes and positions, as a geometrical point in a multi-dimensional space. With appropriate transformation, typical vector quantization techniques can be directly applied. This method is extended to the design of a multipulse excitation codebook for a CELP coder with a significantly larger codebook size than that of a typical CELP coder. For the best excitation vector search, instead of using direct analysis-by-synthesis procedure, a combined approach of vector quantization and analysis-by-synthesis is used. The expansion of the excitation codebook improves coder performance, while the computational complexity, by using the fast search method, is far less than that of a typical CELP coder.

T. Arazeki, K. Ozawa, S. Ono, and K. Ochiai, "Multipulse Excited Speech Coder Based on Maximum Cross-Correlation Search Algorithm", proc. Global Telecommunications Conf., pp. 734–738, 1983, proposed an efficient method for multipulse excitation signal generation based on crosscorrelation analysis. A similar technique may be used to generate a reference multipulse excitation vector for use in obtaining a multipulse excitation codebook in a manner according to the present invention. A block diagram is given in FIG. 17.

Suppose X(n) is the speech signal in an N-sample frame after subtracting out the spill-over from the previous frames. Assume that I-1 pulses have been determined in position and in amplitude, the I-th pulse is found as follows: Let $m_i$ and $g_i$ be the location and the amplitude of the i-th pulse, respectively, and h(n) be the impulse response of the synthesis filter. The synthesis filter output Y(n) is given by, $$Y(n) = \sum_{i=1}^{I} g_i h(n - m_i) \tag{13}$$

The weighted error $E_w(n)$ between X(n) and Y(n) is expressed as $$\begin{aligned} E_w(n) &= (X(n) - Y(n)) * W(n) \\ &= X_w(n) - \sum_{i=1}^{I} g_i h_w(n - m_i) \end{aligned} \tag{14}$$

where * denotes convolution and $X_w(n)$ and $h_w(n)$ are the weighted signals of X(n) and h(n), respectively. The weighting filter characteristic is given in the Z-transform notation, by $$W(Z) = \left(1 - \sum_{k=1}^{P} a_k Z^{-k}\right) / \left(1 - \sum_{k=1}^{P} a_k \gamma^k Z^{-k}\right) \tag{15}$$

where the $a_k$'s are the predictor coefficients of the Pth-order LPC spectral filter and $\gamma$ is a constant for perceptual weighting control. The value of $\gamma$ is around 0.8 for speech signal sampled at 8 kHz.

The error power $P_w$, which is to be minimized, is defined as $$P_w = \sum_{n=1}^{N} E_w(n)^2 = \sum_{n=1}^{N} \left[ X_w(n) - \sum_{i=1}^{I} g_i h_w(n - m_i) \right]^2 \tag{16}$$

Given that I-1 pulses were determined, the I-th pulse location $m_I$ is found by setting the derivative of the error power $P_w$ with respect to the I-th amplitude $g_I$ to zero for $1 \leqq m_I \leqq N$. The following equation is obtained:

$$g_I = \frac{\sum_{n=1}^{N} X_w(n)h_w(n - m_I) - \sum_{k=1}^{I-1}\left[g_k \sum_{n=1}^{N} h_w(n - m_k)h_w(n - m_I)\right]}{\sum_{n=1}^{N} h_w(n - m_I)h_w(n - m)_I)} \quad (17)$$

From the above two equations, it is found that the optimum pulse location is given at point $m_I$ where the absolute value of $g_I$ is maximum. Thus, the pulse location can be found with small calculation complexity. By properly processing the frame edge, the above equation can be further reduced to $$g_I = \frac{R_{hx}(m_I) - \sum_{k=1}^{I-1} g_k R_{hh}(m_k - m_I)}{R_{hh}(o)} \quad (18)$$

where $R_{hh}(m)$ is the autocorrelation of $h_w(n)$, and $R_{hx}(m)$ is the crosscorrelation between $h_w(n)$ and $X_w(n)$. Consequently, the optimum pulse location $m_I$ is determined by searching the absolute maximum point of $g_I$ from eq. (18). For initialization, the optimum position $m_I$ of the first pulse is where $R_{hx}(m)$ reaches its maximum, and the optimum amplitude is $$g_1 = \frac{R_{hx}(m_1)}{R_{hh}(o)} \quad (19)$$

Figure 17:
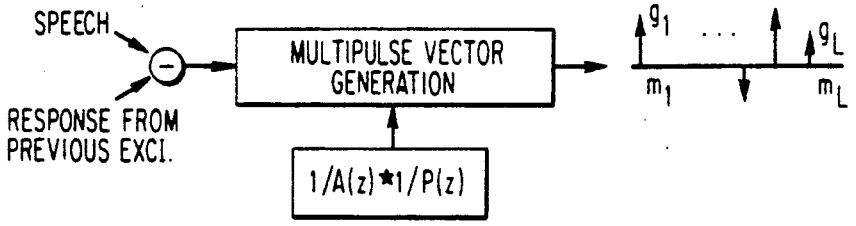
FIG. 17 is a block diagram of a multipulse vector generation technique according to the present invention.

For multipulse excitation signal generation, either the LPC spectral filter (A(Z)) alone can be used, or a combination of the spectral filter and the pitch filter (P(Z)) can be used, e.g., as shown in FIG. 17, where 1/A(Z) * 1/P(Z) denotes the convolution of the impulse responses of the two filters. From computer simulation and informal listening results, it has been found that, with spectral filter alone, approximately 32–64 pulses per frame is enough to produce high quality speech. At 64 pulses per frame, the reconstructed speech is indistinguishable from the original. At 32 pulses per frame, the reconstructed speech is still good, but is not as "rich" as the original. With both the spectral filter and the pitch filter, the number of pulses can be further reduced.

Given fixed pulse positions, the coder performance is improved by re-optimizing the pulse amplitudes jointly. The resulting multipulse excitation signal is characterized by a single multipulse vector $V=(m_1, \ldots, m_L, g_1, \ldots, g_L)$, where L is the total number of pulses per frame.

2. Multipulse Vector Coding

For multipulse vector coding, a key concept is to treat the vector $V=(m_1, \ldots, m_L, g_1, \ldots, g_L)$ as a numerical vector, or a geometrical point in a 2L-dimensional space. With appropriate transformation, an efficient vector quantization method can be directly applied.

For multipulse vector coding, several codebooks are constructed beforehand. First, a pulse position mean vector (PPMV) and a pulse position variance vector (PPVV) are computed using a large training speech data base. Given a set of training multipulse vectors $(V=(m_1, \ldots, m_L, g_1, \ldots, g_L)$, PPMV and PPVV are defined as $$PPMV = (E(m_1), \ldots, E(m_L)) \quad (20)$$

$$PPVV = (\sigma(m_1), \ldots, \sigma(m_L))$$

where E(.) and $\sigma$(.) denote the mean and the standard deviation of the argument, respectively. Each training multipulse vector $\hat{V}$ is then converted to a corresponding vector $\hat{V}=(\hat{m}_1, \ldots, \hat{m}_L, \hat{g}_1, \ldots, \hat{g}_L)$, where $$\hat{m}=(m_i-E(m_i))/\sigma(m_i) \quad (21)$$

and $$\hat{g}_i=g_i/G$$

where G is a gain term given by $$G = \left(\frac{1}{L}\sum_{i=1}^{L} g_i^2\right)^{\frac{1}{2}}$$

Each vector $\hat{V}$ can be further transformed using some data compressive operation. The resulting training vectors are then used to design a codebook (or codebooks) for multipulse vector quantization.

It is noted here that the transformation operation in (21) does not achieve any data compression effect. It is merely used so that the designed vector quantizer can be applied to different conditions, e.g., different subset of the position vector or different speech power levels. A good data compressive transformation of the vector V would improve the vector quantizer resolution (given a fixed data rate) which is quite useful in the application of this technique to low-data-rate speech coding area. However, at present, an effective transformation method has yet to be found.

Depending on the data rates available, and the resolution requirement of the vector quantizer, different vector quantizer structures can be used. Examples are predictive vector quantizers, multi-stage vector quantizers, and so on. By regarding the multipulse vector as a numerical vector, a simple weighted Euclidean distance can be used as the distortion measure in vector quantizer design. The centroid vector in each cell is computed by simple averaging.

For on-line multipulse vector coding, each vector V is first converted to $\hat{V}$ as given in (21). Each vector $\hat{V}$ is then quantized by the designed vector quantizer. The quantized vector is denoted as $q(\hat{V})=(q(\hat{m}_1), \ldots, q(\hat{m}_L), q(\hat{g}_1), \ldots, q(\hat{g}_L))$. At the decoding side, the coded multipulse vector is reconstructed as a vector $\hat{V}=(\hat{m}_1, \ldots, \hat{m}_L, \hat{g}_1, \ldots, \hat{g}_L)$, where $$\hat{m}_i=[q(\hat{m}_i)\sigma(m_i)+E(m_i)]$$

$$\hat{q}_i=q(\hat{g}_i)q(G)$$

q(G) denotes the quantized value of G, where G is the gain term computed through a closed-loop procedure in finding the best excitation signal. [.] denotes the closest integer to the argument.

In general, a 2L-dimensional vector is too large in size for efficient vector quantizer design. Hence, it is necessary to divide the vector into sub-vectors. Each sub-vector is then coded using separate vector quantizers. It is obvious at this point that, given a fixed bit rate, there exists a compromise in system design regarding an increase of the number of pulses in each frame and an increase in the resolution of multipulse vector quantization. A best compromise can only be found through experimentation.

The multipulse vector coding method may be extended to the design of the excitation codebook for a CELP coder (or for a general multipulse-excited linear predictive coder). The targeted overall data rate is 4.8 kbps. The objective is two-fold: first, to increase significantly the size of the excitation codebook for performance improvement, and second, to maintain high enough resolution of multipulse vector quantization so that the (ideal) non-quantized multipulse vector for the current frame can be used as a reference vector for an excitation fast-search procedure. The fast search procedure involves using the reference multipulse vector to select a small subset of candidate excitation vectors. An analysis-by-synthesis procedure then follows to find the best excitation vector from this subset. The reason for using the two-step, combined vector quantization and analysis-by-synthesis approach is that at this low data rate, the resolution of the multipulse vector quantization is relatively coarse so that an excitation vector which is closest to the reference multipulse vector in terms of the (weighted) Euclidean distance may not be the one excitation that produces the closest replica (in terms of perceptually weighted distortion measure) to the original speech. The key design problem, hence, is to find the best compromise in system design so that the coder performance is maximized.

For the targeted overall data rate at 4.8 kbps, the number of pulses in each speech frame, L, is chosen at 30 as a good compromise in terms of coder performance and vector quantizer resolution for fast search. To match the pitch filter update rate (three times per frame), three multipulse excitation vectors, V, each with $l=L/3$ pulses, are computed in each frame. Each transformed multipulse vector $\hat{V}$ is decomposed into two vectors, an amplitude vector $\hat{V}_m=(\hat{m}_1, \ldots, \hat{m}_l)$ and a position vector $\hat{V}_g=(\hat{g}_1, \ldots, \hat{g}_l)$, for separate vector quantization. Two 8-bit, 10-dimensional, full-search vector quantizers are used to encode $\hat{V}_m$ and $\hat{V}_g$, respectively. With different combinations, the effective size of the excitation codebook for each combined vector of $\hat{V}_m$ and $\hat{V}_g$ is 256'256=5,536. This is significantly larger than the corresponding size of the excitation codebook (usually $\leqq 1024$) used in a typical CELP coder. In addition, the computer storage requirement for the excitation codebook in this case is $(256+256)\times 10=5120$ words. Compared to the corresponding amount required (approximately $1024\times 40=40960$) words, for a 10-bit random Gaussian codebook used in a typical CELP coder, the memory saving is also significant.

Figure 27:
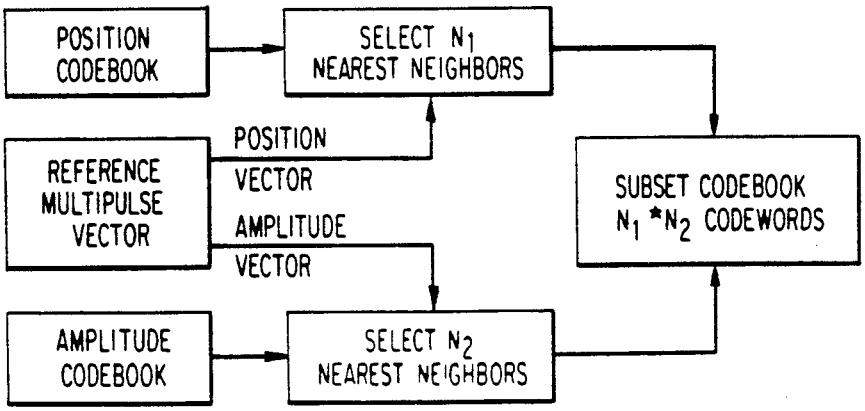
FIG. 27 is a diagram of an excitation codebook fast-search method according to the present invention.

For the search of the best excitation multipulse vector in each one of the three excitation subframes, a two-step, fast search procedure is followed. A block diagram of the fast search method is shown in FIG. 27. First, the a reference multipulse vector, which is the unquantized multipulse signal for the current sub-frame, is generated using the crosscorrelation analysis method described in the above-cited paper by Arazeki et al. The reference multipulse vector is decomposed into a position vector $\hat{V}_m$ and an amplitude vector $\hat{V}_g$ which are then quantized using the two designed vector quantizers in accordance with amplitude and position codebooks. The $N_1$ codewords which have the smallest predefined distortion measures from $\hat{V}_g$ are chosen, and the $N_2$ codewords which have the smallest predefined distortion measures from $\hat{V}_m$ are also chosen. A total of $N_1\times N_2$ candidate multipulse excitation vectors $\hat{V}=(\hat{m}_1, \ldots, \hat{m}_l, \hat{g}_1, \ldots, \hat{g}_l)$ are formed. These excitation vectors are then tried one by one, using an analysis-by-synthesis procedure used in a CELP coder, to select the best multipulse excitation vector for the current excitation sub-frame. Compared to a typical CELP coder which requires $4\times 1024$ analysis-by-synthesis steps in a single frame (assuming there are four subframes and 1024 excitation code-vectors), the computational complexity of the proposed approach is far less. Moreover, the use of multipulse excitation also simplifies the synthesis process required in the analysis-by-synthesis steps.

With random excitation codebooks, a CELP coder is able to produce fair to good-quality speech at 4.8 kbps, but (near) toll-quality speech is hardly achieved. The performance of the CELP speech coder may be enhanced by employing the multipulse excitation codebook and the fast search method described above.

Figure 18:
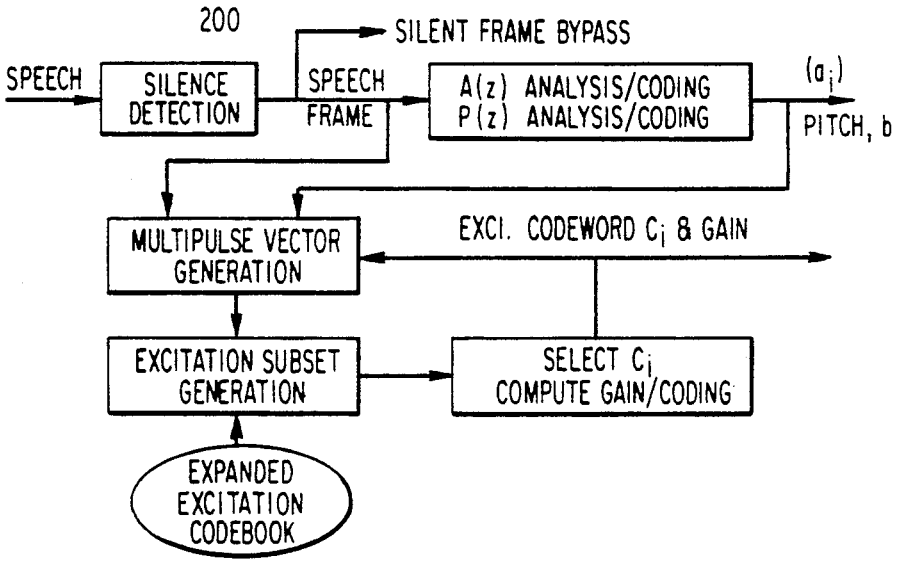
FIGS. 18(*a*) and 18(*b*) together illustrate a coder using an expanded excitation codebook.
Figure 18:
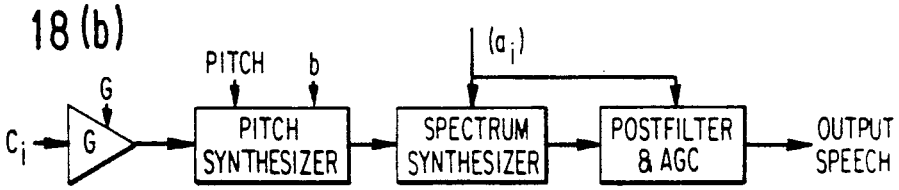

Block diagrams of the encoder and decoder are shown in FIGS. 18(*a*) and 18(*b*). The sampling rate may be 8 kHz with the frame size set at 210 samples per frame. At 4.8 kbps, the data bits available are 126 bits/-frame. The incoming speech signal is first detected by a speech activity detector 200 as a speech frame or not. For a silent frame, the entire encoding/decoding process is bypassed, and frames of white noise of appropriate power level are generated at the decoding side. For speech frames, a linear predictive analysis based on the autocorrelation method is used to extract the predictor coefficients of a 10th-order spectral filter using Hamming windowed speech. The pitch value and the pitch filter coefficient are computed based on a closed-loop procedure described herein. For simplicity of multipulse vector generation, a first-order pitch filter is used.

The spectral filter is updated once per frame. The pitch filter is updated three times per frame. Pitch filter stability is controlled by limiting the magnitude of the pitch filter coefficient. Spectral filter stability is controlled by ensuring the natural ordering of the quantized line-spectrum frequencies. Three multipulse excitation vectors are computed per frame using the combined impulse response of the spectral filter and the pitch filter. After transformation, the multipulse vectors are encoded as previously described. A fast search procedure using the unquantized multipulse vectors as reference vector is then followed to find the best excitation signal.

The coefficient vector of the spectral filter A(Z) is first converted to the line-spectrum frequencies, as described by F. Itakura, "Line Spectrum Representation of Linear Predictive Coefficients of Speech Signals", J. Acoust Soc. Am. 57, Supplement No. 1, 535, 1975, and G. S. Kang and L. J. Fransen, "Low-Bit Rate Speech Encoders Based on Line-Spectrum Frequencies (LSFs)", NRL Report 8857, November, 1984, and then encoded by a 24-bit interframe predictive scheme with a 2-stage ($10\times 10$) vector quantizer. The interframe prediction scheme is similar to the one reported by M. Yong, G. Davidson, and A. Gersho, "Encoding of LPC Spectral Parameters Using Switched-Adaptive Interframe Vector Prediction", proc. ICASSP, pp. 402–405, 1988. The pitch values, with a range of 16–143 samples, are directly coded using 7 bits each. The pitch filter coefficients are scalar quantized using 5 bits each. The multi-pulse gain terms are also scalar quantized using 6 bits each. 48 bits are allocated for the three multipulse vectors' coding.

At the decoding side, the multipulse excitation signal is reconstructed and is then used as the input signal to the synthesizer which includes both the spectral filter and the pitch filter. As in a typical CELP coder, an adaptive post filter of the type described by V. Ramamoorthy and N. S. Jayant, "Enhancement of ADPCM Speech by Adaptive Postfiltering", AT&T Bell Laboratories Tech, Journal, Vol. 63, No. 8, pp. 1465–1475, October, 1984, and J. H. Chen and A. Gersho, "Real-Time Vector APC Speech Coding at 4800 bps with Adaptive Postfiltering", proc. ICASSP, pp. 2185–2188, 1987, is used to enhance the perceived speech quality. A simple gain control scheme is used to maintain the power level of the output speech approximately equal to that before the postfilter.

Using the encoder/decoder of FIGS. 10(*a*)–10(*d*) for comparison, and with a frame size of 220 samples, the number of data bits available at 4.8 kbps was 132 bits/-frame. The spectral filter coefficients were encoded using 24 bits, and the pitch, pitch filter coefficient, gain term and excitation signal were all updated four times per frame. Each was encoded using 7, 5, 6, and 9 bits, respectively. The excitation signal used was the decomposed multipulse excitation model described above.

Both coders were tested against speech signals inside and outside of the training speech data base. By informal listening tests, it was found that E-CELP sounded somewhat smoother and cleaner than CELP.

Since multipulse excitation is able to produce periodic excitation components for voiced sounds, a possible further improvement would be to delete the pitch filter.

Dynamically-weighted Distortion Measure

In the embodiment described above, a mean-squared-error (MSE) distortion measure is used for the fast excitation search. The drawback for using MSE is twofold. First, it requires a significant amount of computation. Second, because it is not weighted, all pulses are treated the same. However, from subjective testing, it has been found that pulses with larger amplitudes in a multipulse excitation vector are more important in terms of the contributions to the reconstructed speech quality. Hence, an unweighted MSE distortion measure is not a suitable choice.

A simple distortion measure is proposed here to solve the problems. Specifically, a dynamically-weighted distortion measure in terms of the absolute error is used. The use of the absolute error simplifies the computation. The use of the dynamic weighting, which is computed according to the pulse amplitudes, ensures that the pulses with larger amplitudes are more faithfully reconstructed. The distortion measure D and the weighting factors, $\omega_i$, are defined as $$D = \sum_{i=1}^{l} \omega_i |x_i - y_i|$$

where $$\omega_i = \frac{|g_i|}{\sum_{j=1}^{l} |g_j|}$$

where $x_i$ denotes the component of the multipulse amplitude (or position) vector, $y_i$ denotes the component of the corresponding multipulse amplitude (or position) codeword, $g_i$'s denote the multipulse amplitudes, and l is the dimension of the multipulse amplitude (or position) vector. Reconstruction of the pulses with smaller amplitudes, which are relatively more coarsely quantized in the first step of the fast-search procedure, is taken care of in the second step of the fast-search procedure.

Through computer simulation, it has been found that by using a weighted absolute error distortion measure and a weighted MSE distortion measure, the performances were about the same at this data rate. However, the computational complexity is much less for the former case. The reconstruction of the pulses with smaller amplitudes, which are relatively coarser-quantized in the first step of the fast-search procedure, is taken care of in the second step of the fast-search procedure.

DYNAMIC BIT ALLOCATION

In utterances containing many unvoiced segments, it is observed that the pitch synthesizer is less efficient. On the other hand, in stationary voiced segments, the pitch synthesizer is doing most of the work. Hence, to enhance speech codec performance at the low data rate, it is beneficial to test the significance of both the pitch synthesizer and the excitation signal. If they are found to be insignificant in terms of the contribution to the reconstructed speech quality, the data bits can be allocated to other parameters which are in need of them.

The following are two proposed methods for the significance test of the pitch synthesizer. The first is an open-loop method. The second is a closed-loop method. The open-loop method requires less computation, but is inferior in performance to the closed-loop method.

Figure 20:
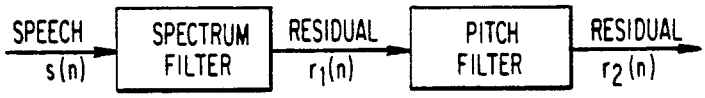
FIG. 20 is a brief block diagram for explaining an open-loop significance test method for a pitch synthesizer according to the present invention.

The open-loop method for the pitch synthesizer significance test is shown in FIG. 20. Specifically, the average powers of the residual signals $r_1(n)$ and $r_2(n)$ are computed, and denoted as $P_1$ and $P_2$, respectively. If $P_2 > rP_1$, where r $(0<r<1)$ is a design parameter, the pitch synthesizer is determined insignificant.

Figure 21:
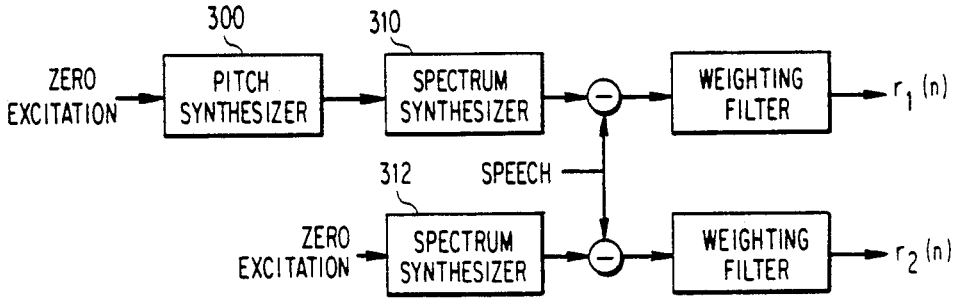
FIG. 21 is a block diagram illustrating a closed-loop significance test method for a pitch synthesizer according to the present invention.

The closed-loop method for pitch synthesizer significance test is shown in FIG. 21. $r_1(n)$ is the perceptually-weighted difference between the speech signal and the response due to memories in the pitch and spectrum synthesizers 300 and 310. $r_2(n)$ is the perceptually-weighted difference between the speech signal and the response due to memory in the spectrum synthesizer 312 only. The decision rule is then to compute the average powers of $r_1(n)$ and $r_2(n)$, denoted as $P_1$ and $P_2$, respectively. If $P_2 > rP_1$, where r $(0<r<1)$ is a design parameter, the pitch synthesizer is insignificant.

As in the case of the pitch synthesizer, two methods are proposed for the significance test of the excitation signal. The open-loop scheme is simpler in computation, whereas the closed-loop scheme is better in performance.

Figure 22:
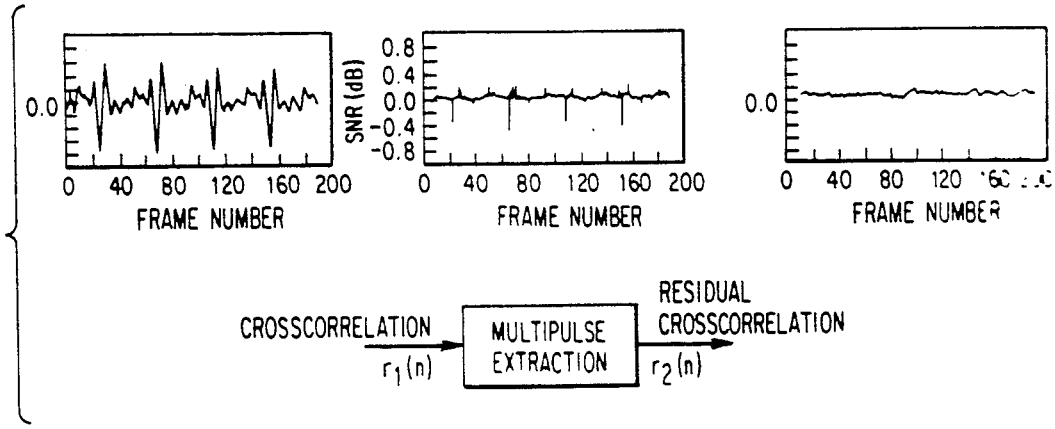
FIG. 22 is a diagram illustrating an open-loop significance test method for a multipulse excitation signal.

The reference multipulse vector used in the fast excitation search procedure described above is computed through a cross-correlation analysis. The cross-correlation sequence and the residual cross-correlation sequence after multipulse extraction are shown in FIG. 22. From this figure, a simple open-loop method for testing the significance of the excitation signal is proposed as follows:

Compute the average powers of $r_1(n)$ and $r_2(n)$, denoted as $P_1$ and $P_2$, respectively.

If $P_2 > rP_1$ or $P_1 < P_r$, where r $(0<r<1)$ and $P_r$ are design parameters, the excitation signal is insignificant.

Figures 23, 24:
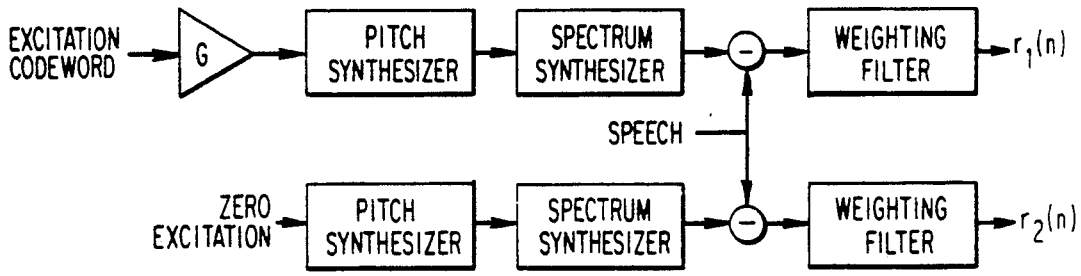
FIG. 23 is a diagram illustrating a closed-loop significance test method for the excitation signal.
FIG. 24 is a chart for explaining a dynamic bit allocation scheme according to the present invention.

The closed-loop method for the excitation significance test is shown in FIG. 23. $r_1(n)$ is the perceptually-weighted difference between the speech signal and the response of $GC_i$ (where $C_i$ is the excitation codeword and G is the gain term) through the two synthesizing filters. $r_2(n)$ is the perceptually-weighted difference between the speech signal and the response of zero excitation through the two synthesizing filters. The decision rule is to compute the average powers of $r_1(n)$ and r 2(n), denoted as $P_1$ and $P_2$, respectively. If $P_1 > rP_2$, where r $(0<r<1)$ is a design parameter, the excitation signal is significant.

In the preferred embodiment of the speech codec according to this invention, the pitch synthesizer and the excitation signal are updated synchronously several (e.g., 3–4) times per frame. These update intervals are referred to herein as subframes. In each subframe, there are three possibilities, as shown in FIG. 24. In the first case, the pitch synthesizer is determined insignificant. In this case, the excitation signal is important. In the second case, both the pitch synthesizer and the excitation signal are determined significant. In the third case, the excitation signal is determined insignificant. The possibility that both the pitch synthesizer and the excitation signal are insignificant does not exist, since the 10th order spectrum synthesizer cannot fit the original speech signal that well.

If the pitch synthesizer in a specific subframe is found insignificant, no bit is allocated to it. The data bits $B_p$, which include the bits for pitch and the pitch gain(s), are saved for the excitation signal in the same subframe or one of the following subframes. If the excitation signal in a specific subframe is found insignificant, no bit is allocated to it. The data bits $B_G+B_e$, which include $B_G$ bits for the gain term and $B_e$ bits for the excitation itself, are saved for the excitation signal in one of the following subframes. Two bits are allocated to specify which one of the three cases occurs in each subframe. Also, two flags are kept synchronously in both the transmitter and the receiver to specify how many $B_p$ bits and how many $B_G+B_e$ bits saved are still available for the current and the following subframes.

Figure 9:
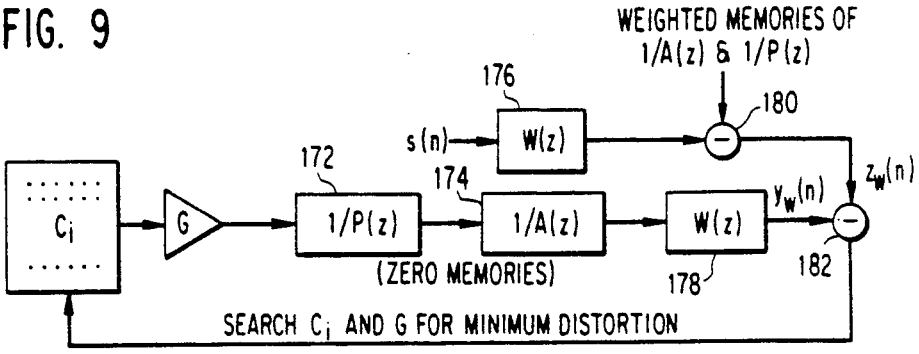
FIG. 9 is an equivalent block diagram of FIG. 8.

The data bits saved for the excitation signals in the following subframes are utilized as a two-stage closed-loop scheme for searching the excitation codewords $C_{i1}$, $C_{i2}$, and for computing the gain terms $G_1$, $G_2$, where the subscripts 1 and 2 indicate the first and second stages, respectively. For the first stage, the closed-loop method shown in FIG. 9 is used, where 1/P(z), 1/A(z), and W(z) denote the pitch synthesizer, spectrum synthesizer, and perceptual weighting filter, respectively, $z_w(n)$ is the weighted speech residual after subtracting out the weighted memories of the spectrum synthesizer and the pitch synthesizer, and $y_w(n)$ is the response of passing the excitation signal $GC_i$ through the pitch synthesizer set to zero. Each codeword $C_i$ is tried, and the one $C_i$ that produces the minimum mean-squared-error distortion between $z_w(n)$ and $y_w(n)$ is selected as the best excitation codeword $C_{i1}$. The corresponding gain term is then computed as $G_1$.

For the second stage, the same procedure is followed to find $C_{i2}$ and $G_2$. The only differences are as follows:

1. $z_w(n)$ is now the weighted speech residual after subtracting out the weighted memories of the spectrum synthesizer, the pitch synthesizer, and $y_w(n)$ (produced by the selected excitation $G_1C_{i1}$ in the first stage).
2. Depending on the extra bits available for the excitation, e.g., $B_e$ or $B_p-B_G$ at the second stage (as shown in FIG. 24), the excitation codebook is different. If $B_e$ bits are available, the same excitation codebook is used for the second stage. If $B_p-B_G$ bits are available, where $B_p-B_G$ is usually smaller than $B_e$, only the first $2^{Bp-BG}$ codewords out of the $2^{Be}$ codewords are used.

Referring again to FIG. 24, in the first case where the pitch synthesizer is insignificant, the excitation signal is important. Hence, if $B_G+B_e$ extra bits are available from the previous subframes, they are used here. Otherwise, the $B_p$ bits saved from the previous subframes or the current subframe are used. In the second case, where both the pitch synthesizer and the excitation signal are significant, three possibilities exist. First, no extra bits are available from the previous subframes. Second, $B_p$ bits are available from the previous subframes. Third, $B_G+B_e$ bits are available from the previous subframes. One may choose to allocate zero bits to the second stage in this case, and save the extra bits for the first case in the following subframes. Or one may choose to use $B_p$ bits, instead of $B_G+B_e$ bits, if both are available, and save the $B_G+B_e$ bits for the first case in the following subframes. A best choice can be found through experimentation.

Iterative Joint Optimization of The Speech Codec Parameters

For an optimum performance for the synthesizer structure of FIG. 2 (under the constraint of this structure and the available data rate), all parameters should be computed and optimized jointly to minimize the perceptually-weighted distortion measure between the original and the reconstructed speech. These parameters include the spectrum synthesizer coefficients, the pitch value, the pitch gain(s), the excitation codeword $C_i$, the gain term G, and (even) the post-filter coefficients. However, such a joint optimization method would require solution of a set of nonlinear equations with formidable size. Hence, even if the resultant speech quality would definitely be improved, it is impractical to do so.

Figure 25:
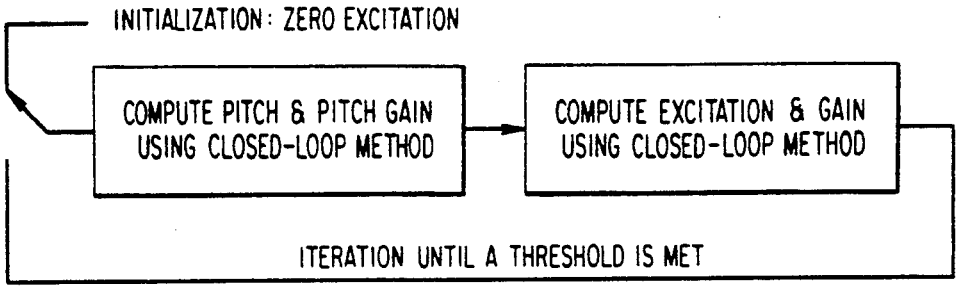
FIG. 25 is a diagram for explaining an iterative joint optimization method according to the present invention.

For a smaller degree of speech quality improvement, however, some suboptimum schemes could be used. An example is shown in FIG. 25. Here, the scale of joint optimization is limited to include only the pitch synthesizer and the excitation signal. Moreover, instead of direct joint optimization, an iterative joint optimization method is used. For initialization, with zero excitation, the pitch value and the pitch gain(s) are computed by a closed-loop approach, e.g., in the manner described above with reference to FIG. 10(*b*). Then, by fixing the pitch synthesizer, a closed loop approach is used to compute the best excitation codeword $C_i$ and the corresponding gain term G. The switch in FIG. 25 is then moved to close the lower loop of the diagram. That is, the computed best excitation ($GC_i$) is now used as the input, and the pitch value and the pitch gain(s) are recomputed. The process continues until a threshold is met that no more significant improvement in speech quality (in terms of the distortion measure) can be achieved. By using this iterative approach, the reconstructed speech quality can be improved without requiring a formidable increase in the computational complexity.

Figure 26:
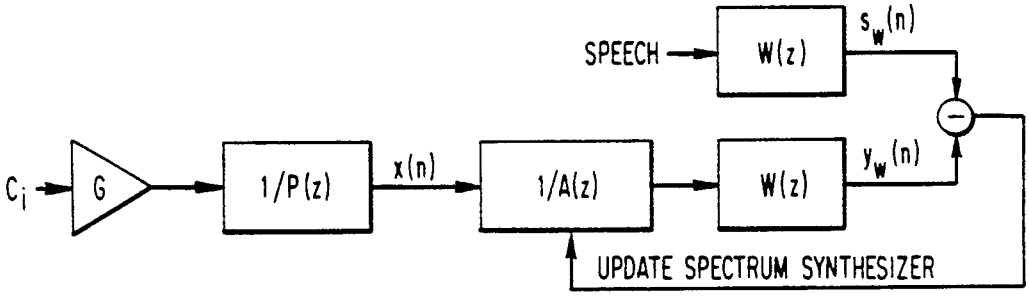
FIG. 26 is a diagram illustrating the application of the joint optimization technique to include the spectrum synthesizer.

The same procedure can be extended to include the spectrum synthesizer of the type shown in FIG. 10(*c*), as shown in FIG. 26, where 1/P(Z), 1/A(Z) and W(Z)

denote the pitch synthesizer, the spectrum synthesizer and the perceptual weighting filter, respectively, and are defined as above in equations (6a) and (6b). The combined transfer function of 1/A(z) and W(z) can be written as 1/A'(z) where $$A'(Z) = 1 - \sum_{i=1}^{10} a_i Z^{-i} (a_i = a_i \cdot \gamma^i)$$

For initialization, A(Z) is computed as in a typical linear predictive coder, i.e., using either the autocorrelation or the covariance method. Given A(Z), the pitch synthesizer is computed by the closed-loop method as described before. The excitation signal $C_i$ and the gain term G are then computed. The iterative joint optimization procedure now goes back to recompute the spectrum synthesizer, as shown in FIG. 26. A simplified method to do this is to use the previously computed spectrum synthesizer coefficients $\{a_i\}$ as the starting point, and use a gradient search method, e.g., as described by B. Widrow and S. D. Stearns, *Adaptive Signal Processing*, Prentice-Hall, 1985, to find the new set of coefficients to minimize the distortion between $S_w(n)$ and $Y_w(n)$. This procedure is formulated as follows:

$$Y_w(n) = \sum_{i=1}^{10} a_i Y_w(n - i) + X_n$$

and $$\text{Minimize} \sum_{n=1}^{N} (S_w(n) - Y_w(n))^2$$

where N is the analysis frame length. To avoid the complicated moving-target problem, the weighting filter W(z) for the speech signal is assumed to be fixed based on the spectrum synthesizer coefficients computed by the open-loop method. Only the weighting filter W(z) for the spectrum synthesizer 1/A(z) is assumed to be updated synchronously with the spectrum synthesizer. Then, the pitch synthesizer and the excitation signal are recomputed until a pre-determined threshold is met.

It is noted here that, unlike the pitch filter, the stability of the spectrum filter has to be maintained during the recomputation process. Also, the iterative joint optimization method proposed here can be applied over a large class of low data rate speech coders.

Adaptive Post-Filtering and Automatic Gain Control

The adaptive post filter P(Z) is given by $$P(Z) = [(1 - \mu z^{-1}) A(Z/\beta)] A^{-1}(Z/\alpha) \quad (22)$$

where A(Z) is $$A(Z) = 1 + \sum_{i=1}^{10} a_i Z^{-i} \quad (23)$$

Figure 19:
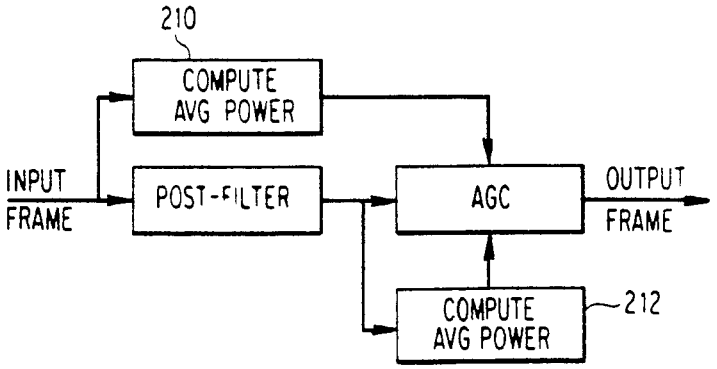
FIG. 19 is a block diagram illustrating an automatic gain control technique according to the present invention.

$a_i$'s are the predictor coefficients of the spectrum filter $\alpha$, $\beta$ and $\mu$ are design constants chosen to be around 0.7, 0.5 and 0.35 $K_1$, where $K_1$ is the first reflection coefficient. A block diagram for AGC is shown in FIG. 19. The average power of the speech signal before post-filtering is computed at 210, and the average power of the speech signal after post-filtering is computed at 212. For automatic gain control, a gain term is computed as the ratio between the average power of the speech signal after post-filtering and before post-filtering. The reconstructed speech is then obtained by multiplying each speech sample after post-filtering by the gain term.

The present invention comprises a codec including some or all of the features described above, all of which contribute to improved performance especially in the 4.8 kbps range.

It will be appreciated that various changes and modifications may be made to the specific examples of the invention as described herein without departing from the spirit and scope of the invention as defined in the appended claims.

What is claimed is:

1. An apparatus for encoding an input speech signal into a plurality of coded signal portions, said apparatus including first means responsive to said input speech signal for generating at least a first coded signal portion of said plurality of coded signal portions and second means responsive to said input speech signal and to at least said first coded signal portion for generating at least a second coded signal portion of said plurality of coded signal portions, said first means comprising iterative optimization means for (1) determining an optimum value for said first coded signal portion assuming no excitation signal, and providing a corresponding first output, (2) determining an optimum value for said second coded signal portion based on said first output and providing a corresponding second output, (3) determining a new optimum value for said first coded signal portion assuming said second output as an excitation signal, and providing a corresponding new first output, (4) determining a new optimum value for said second coded value based on said new first output, and providing a corresponding new second output, and (5) repeating steps (3) and (4) until said first and second coded signal portions are optimized.

2. An apparatus as defined in claim 1, wherein said second means generates said second coded signal portion by generating a predicted value of said input speech signal and comparing said predicted value to said input speech signal, and wherein steps (3) and (4) are repeated until an amount of distortion between said predicted value and said input speech signal is minimized.

3. An apparatus as defined in claim 1, wherein said plurality of coded signal portions includes spectrum filter coefficients, and said iterative optimization means including means for first calculating an initial set of spectrum filter coefficients, then deriving said first and second optimized coded signal portions according to steps (1)-(5) in claim 1, and then deriving an optimized set of spectrum filter coefficients in accordance with at least said first and second optimized coded signal portions and said initial set of spectrum filter coefficients.

4. A speech analysis and synthesis method comprising the steps of deriving a set of predictor coefficients for each analysis time period from an original input signal having a plurality of successive analysis time periods, coding said predictor coefficients to obtain a coded representation of said coefficients, transmitting the coded representation of said predictor coefficients to a decoder and synthesizing the original input speech signal in accordance with said transmitted coded representation of said predictor coefficients, said coding step comprising:

transforming said set of predictor coefficients for one analysis time period into parameters in a parameter st to form a parameter vector;

subtracting from said parameter vector a mean vector determined in advance from a large speech data base to obtain an adjusted parameter vector;

selecting from a codebook of $2^L$ entries (where L is an integer), prepared in advance from said large speech data base, a prediction matrix A such that $$\hat{F}_n = AF_{n-1}$$

where n is an integer, $\hat{F}_n$ is a predicted parameter vector for said one analysis time period and $F_{n-1}$ is the adjusted parameter vector for an immediately preceding analysis time period;

calculating a predicted parameter vector for said one analysis time period as well as a residual parameter vector comprising the difference between said predicted parameter vector and said adjusted parameter vector;

quantizing said residual parameter vector in a first stage vector quantizer by selecting one of $2^M$ (where M is an integer) first quantization vectors to obtain an intermediate quantized vector;

calculating a residual quantized vector comprising the difference between said intermediate quantized vector and said residual parameter vector;

quantizing said residual quantized vector in a second stage vector quantizer by selecting one of $2^N$ (where N is an integer) second quantization vectors to obtain a final quantized vector; and forming said transmitted coded representation of said predictor coefficients by combining an L-bit value representing the prediction matrix A, an M-bit value representing said intermediate quantized vector and an N-bit value representing said final quantized vector.

5. A speech analysis and synthesis method as defined in claim 4, wherein said parameters comprise line spectrum frequencies.

6. A speech analysis and synthesis method as defined in claim 4, wherein L=6, M=10 and N=10.

7. A speech analysis and synthesis method comprising the steps of deriving a set of predictor coefficients for each analysis time period from an original input signal having a plurality of successive analysis time periods, coding said predictor coefficients to obtain a coded representation of said coefficients, transmitting the coded representation of said predictor coefficients to a decoder and synthesizing the original input speech signal in accordance with said transmitted coded representation of said predictor coefficients, said coding step comprising:

generating a multi-component input vector corresponding to said set of predictor coefficients for one analysis time period, with each component of said vector corresponding to a frequency;

quantizing said input vector by selecting a plurality of multi-component quantization vectors from a quantization vector storage means and calculating for each selected quantization vector a distortion measure in accordance with the difference between each component of said input vector and each corresponding component of the selected quantization vector, and in accordance with a weighting factor associated with each component of said input vector, the weighting factor being determined for each component of said input vector in accordance with the frequency to which said component corresponds;

selecting as a quantizer output the one of said plurality of selected quantization vectors resulting in the least distortion measure; and generating said transmitted coded representation in accordance with the selected quantizer output.

8. A speech analysis and synthesis method as defined in claim 7, wherein said weighting factor is given by $$\omega_i = \begin{cases} u(f_i)\sqrt{D_i/D_{max}} & 1.375 \leqq D_i \leqq D_{max} \\ u(f_i)\sqrt{D_i/1.375D_{max}} & D_i < 1.375 \end{cases}$$

where $$u(f_i) = \begin{cases} 1 & 1.375 < f_i < 1000\ \text{Hz} \\ \frac{-0.5}{3000}(f_i - 1000) + 1 & 1000 \leqq f_i \leqq 4000\ \text{Hz} \end{cases}$$

where $f_i$ denotes the frequency represented by the ith component of the input vector, $D_i$ denotes a group delay for $f_i$ in milliseconds, and $D_{max}$ is a maximum group delay.

9. A speech analysis and synthesis method as defined in claim 8, wherein said distortion measure is given by $$D = \sum_{i=1}^{K} \omega_i(X_i - \gamma_i)^2$$

where $X_i$, $\gamma_i$ denote respectively, the components of the input vector and the corresponding components of each selected quantization vector, and $\omega$ is the corresponding weighting factor.

10. A speech analysis and synthesis system comprising:

excitation signal generating means for generating for each of a plurality of analysis time periods of an input speech signal a multipulse excitation signal comprising a sequence of excitation pulses each having an amplitude and a position within said analysis time period, said excitation signal generating means comprising:

means for storing a plurality of pulse amplitude codewords;

means for storing a plurality of pulse position codewords; and means for reading a pulse amplitude codeword and a pulse position codeword to form said multipulse excitation pulse; and means for subsequently regenerating said speech signal in accordance with said multipulse excitation signals.

11. A speech analysis and synthesis method comprising the steps of:

generating for each of a plurality of analysis time periods of an input speech signal a multipulse excitation vector representing a sequence of excitation pulses each having an amplitude and a position within said analysis time period, said generating step comprising:

selecting a pulse position codeword from a stored plurality of pulse position codewords;

selecting a pulse amplitude codeword from a stored plurality of pulse amplitude codewords; and combining said selected pulse position and pulse amplitude codewords to form said multipulse excitation vector; and subsequently regenerating said speech signal in accordance with said multipulse excitation vector.

12. A speech analysis and synthesis method as defined in claim 11, wherein each multipulse excitation vector is of the form $V=(m_1, \ldots, m_L, g_1, \ldots, g_L)$, where L is the total number of excitation pulses represented by said vector, $m_L$ and $g_L$ are pulse position and pulse amplitude codewords, respectively, corresponding to the L-th excitation pulse in said vector, and wherein said step of selecting a pulse position codeword comprises determining a position $m_I$ within said analysis time period at which the absolute value of $g_I$ has a maximum value, where $m_I$ and $g_I$ are the position and amplitude of an I-th excitation pulse; and selecting a pulse position codeword $m_i$ for said I-th excitation pulse in accordance with the determined value of $m_I$.

13. A speech analysis and synthesis method as defined in claim 12, wherein said step of selecting a pulse amplitude codeword comprises the steps of:

calculating an amplitude $g_I$ for said I-th excitation pulse in accordance with said determined position $M_I$.

14. A speech analysis and synthesis method as defined in claim 12, wherein said speech signal is regenerated using a synthesis filter, and wherein $g_I$ is given by:

$$g_I = \frac{\sum_{n=1}^{N} X_w(n)h_w(n-m_I) - \sum_{k=1}^{I-1}\left[g_k \sum_{n=1}^{N} h_w(n-m_k)h_w(n-m_I)\right]}{\sum_{n=1}^{N} h_w(n-m_I)h_w(n-m)_I)}$$

wherein $X_w(n)$ is a weighted speech signal and $h_w(n)$ is a weighted impulse response of said synthesis filter.

15. A speech analysis and synthesis method as defined in claim 12, wherein said speech signal is regenerated using a synthesis filter, and wherein $g_I$ is given by:

$$g_I = \frac{R_{hx}(m_I) - \sum_{k=1}^{I-1} g_k R_{hh}(m_k - m_I)}{R_{hh}(0)}$$

where $R_{hh}(m)$ is the autocorrelation of $h_w(n)$, $h_w(n)$ is a weighted impulse response of said synthesis filter, $R_{hx}(m)$ is the crosscorrelation between $h_w(n)$ and $X_w(n)$, and $X_w(n)$ is a weighted speech signal.

16. A speech analysis and synthesis method as defined in claim 12, wherein said step of selecting a pulse position codeword comprises:

determining a position $m_1$ within said analysis time period at which $R_{hx}(m)$ has a maximum value, where $R_{hx}(m)$ is the crosscorrelation between a weighted impulse response $h_w(n)$ of said synthesis filter and a weighted speech signal $X_w(n)$; and selecting a pulse position codeword in accordance with said determined position $m_1$.

17. A speech analysis and synthesis method as defined in claim 16, wherein said step of selecting a pulse amplitude codeword comprises:

determining a value for the amplitude $g_1$ of said first excitation pulse according to:

$$g_1 = \frac{R_{hx}(m_1)}{R_{hh}(0)}$$

where $R_{hh}(0)$ is the autocorrelation of $h_w(0)$.

18. A speech analysis and synthesis method as defined in claim 11 wherein each said multipulse excitation vector is of the form $V=(m_1, \ldots, m_L, g_1, \ldots, g_L)$, where L is the total number of excitation pulses represented by said vector, $m_i$ and $g_i 1 \leqq i \leqq L$, are position-related and amplitude-related terms, respectively, corresponding to the i-th excitation pulse in said vector, said method further comprising coding said vectors and decoding said vectors prior to said regenerating step, said coding step comprising:

generating from said vector V a position reference subvector $\hat{V}_m$ and an amplitude reference subvector vector $\hat{V}_g$;

selecting from a position codebook a plurality of position codewords in accordance with said position reference subvector;

selecting from an amplitude codebook a plurality of amplitude codewords in accordance with said amplitude reference subvector;

generating a plurality of position codeword/amplitude codeword pairs from various combinations of said selected position and amplitude codewords;

calculating a distortion measure between said multipulse excitation vector and each position codeword/amplitude codeword pair; and selecting a position codeword/amplitude codeword pair resulting in the lowest distortion measure.

19. A speech analysis and synthesis method comprising the steps of:

generating for each of a plurality of analysis time periods of an input speech signal a multipulse excitation vector representing a sequence of excitation pulses each having an amplitude and a position within said analysis time period, coding said multipulse excitation vectors, wherein said coding step comprises:

generating for each multipulse excitation vector a difference excitation vector which is a function of the difference between said each multipulse excitation vector and a reference multipulse excitation vector; and quantizing said difference excitation vector to obtain said coded multipulse excitation vectors;

decoding the coded multipulse excitation vectors; and subsequently regenerating said speech signal in accordance with decoded multipulse excitation vectors.

20. A speech analysis and synthesis method as defined in claim 19, wherein each multipulse excitation vector is of the form $V=(m_1, \ldots, m_L, g_1, \ldots, g_L)$, where L is the total number of excitation pulses represented by said vector, $m_i$ and $g_i$, $1 \leqq i \leqq L$, are pulse position and pulse amplitude codewords, respectively, corresponding to the i-th excitation pulse in said vector, and wherein said difference excitation vector is given by $\hat{V}=(\hat{m}_1, \ldots, \hat{m}_L, \hat{g}_1, \ldots, \hat{g}_L)$, where $$\hat{m}_i = m_i - m_1')/m_1''$$

and $\hat{g}_i = g_i/G$ where $m_1'$ and $m'$ are taken from first and second reference vectors $V' = (m_1', \ldots, m_L', g_1', \ldots, g_L')$ and $V'' = (m_1'', \ldots, m_L'', g_1'', \ldots, g_L'')$ prepared in advance from a large speech data base, and G is a gain term given by $$G = \left( \frac{1}{L} \sum_{i=1}^{L} g_i^2 \right)^{\frac{1}{2}}.$$

21. A speech analysis and synthesis method as define din claim 20, wherein $m_1'$ is the mean of all values of $m_i$ in said large speech data base.

22. A speech analysis and synthesis method as defined in claim 21, wherein $m_1''$ is the standard deviation of all values of $m_i$ in said large speech data base.

23. A speech analysis and synthesis method as defined in claim 20, wherein said coding step further comprises separating said difference vector into a position subvector $(\hat{m}_1, \ldots, \hat{m}_L)$ and an amplitude subvector $(\hat{g}_1, \ldots, \hat{g}_L)$, and then quantizing said position subvector in a first quantizer and quantizing said amplitude subvector in a second quantizer.

24. A speech analysis and synthesis method comprising the steps of:

generating for each of a plurality of analysis time periods of an input speech signal a vector representing a sequence of excitation pulses each having an amplitude and a position within said analysis time period, each of said vectors being of the form $V = (m_1, \ldots, m_L, g_1, \ldots, g_L)$, where L is the total number of excitation pulses represented by said vector, $m_i$ and $g_i$, $1 \leqq i \leqq L$, are position-related and amplitude-related terms, respectively, corresponding to the i-th excitation pulse in said vector;

coding said vectors, wherein said coding step comprises separating said vector into a position subvector $(\hat{m}_1, \ldots, \hat{m}_L)$ and an amplitude subvector $(\hat{g}_1, \ldots, \hat{g}_L)$, and then quantizing said position subvector in a first quantizer and quantizing said amplitude subvector in a second quantizer, with the quantized position subvector and quantized amplitude subvector together comprising said coded vector;

decoding the coded vectors; and subsequently regenerating said speech signal in accordance with decoded vectors.

25. A speech analysis and synthesis method comprising the steps of:

generating, for each of a plurality of analysis time periods of an input speech signal, a vector representing a sequence of excitation pulses each having an amplitude and a position within said analysis time period, each said vector being is of the form $V = (m_1, \ldots, m_L, g_1, \ldots, g_L)$, where L is the total number of excitation pulses represented by said vector, $m_i$ and $g_i$, $1 \leqq i \leqq L$, are position-related and amplitude-related terms, respectively, corresponding to the i-th excitation pulse in said vector;

coding said vectors, wherein said coding step comprises:

generating from a given one of said vectors a position reference subvector $\hat{V}_m$ and an amplitude reference subvector vector $\hat{V}_g$;

selecting from a position codebook a plurality of position codewords in accordance with said position reference subvector;

selecting from an amplitude codebook a plurality of amplitude codewords in accordance with said amplitude reference subvector;

generating a plurality of position codeword/amplitude codeword pairs from various combinations of said selected position and amplitude codewords;

calculating a distortion measure between said given vector and each position codeword/amplitude codeword pair; and selecting a position codeword/amplitude codeword pair resulting in the lowest distortion measure as a coded version of said given vector;

decoding the coded vectors; and subsequently regenerating said speech signal in accordance with decoded vectors.

26. A speech analysis and synthesis method as defined in claim 25, wherein said distortion measure comprises a dynamically weighted distortion measure weighted in accordance with a weighting function which is a function of the amplitude of each amplitude term in each position codeword/amplitude codeword pair.

27. A speech analysis and synthesis method as defined in claim 26, wherein said dynamically weighted distortion measure D is given by, $$D = \sum_{i=1}^{L} \omega_i |x_i - y_i|$$

where $\omega_i$ is said weighting function and is given by $$\omega_i = \frac{|g_i|}{\sum_{j=1}^{L} |g_j|}$$

where $x_i$ denotes a component of said vector, and $y_i$ denotes a corresponding component of a position codeword/amplitude codeword pair.

28. A speech analysis and synthesis method comprising the steps of:

generating a plurality of analysis signals from an input signal, said analysis signals comprising at least a pitch signal portion including a pitch value and a pitch gain value, and an excitation signal portion including an excitation codeword and an excitation gain signal;

coding said analysis signals, wherein said coding step includes the steps of:

classifying each of said pitch signal portions and excitation signal portions as significant or insignificant;

allocating a number of coding bits to each of said pitch signal portions and excitation signal portions in accordance with results of said classifying step; and coding each of said pitch and excitation signals with the number of bits allocated to each; and decoding said analysis signals; and synthesizing said coded speech signal in accordance with the decoded analysis signals.

29. A speech analysis and synthesis method as define din claim 28, wherein said allocating step comprises allocating a greater number of bits to a pitch signal portion classified as significant than to a pitch signal portion classified as insignificant, and allocating a greater number of bits to an excitation signal portion classified as significant than to an excitation signal classified as insignificant.

30. A speech analysis and synthesis method as defined in claim 29, wherein said allocating step comprises allocating zero bits to said pitch signal portion if it is classified as insignificant, and allocating zero bits to said excitation signal portion if it is classified as insignificant.

31. A speech activity detector for use in an apparatus for encoding an input signal having speech and non-speech portions, for determining the speech or non-speech character of said input signal over each of a plurality of successive intervals, said speech activity detector comprising monitoring means for monitoring an energy content of said input speech signal and discriminating means responsive to the monitored energy for discriminating between speech and non-speech input signals, said monitoring means comprising means for determining an average energy of said input signal over one of said intervals and means for determining a minimum value of said average energy over a predetermined number of said intervals; and said discriminating means comprising means for determining a threshold value in accordance with said minimum value and means for comparing said average energy of said input signal over said one interval to said threshold value to determine if said input signal during said one interval represents speech or non-speech.

32. A speech activity detector as defined in claim 31, wherein said one interval is the last of said predetermined number of intervals.

33. A speech activity detector as defined in claim 31, further comprising:

means responsive to the determination that said average energy in said one frame exceeds said threshold value for setting a hangover value in accordance with the number of consecutive intervals for which said threshold has been exceeded; and means responsive to a determination that said average energy for said one interval does not exceed said threshold value for determining that said input signal represents a non-speech portion if said hangover value is at a predetermined level, and otherwise decrementing said hangover value.

34. A speech detector for discriminating between speech and non-speech intervals of an input signal, said speech detector comprising monitoring means for monitoring at least one characteristic of said input signal and discriminating means responsive to said monitoring means for discriminating between speech and non-speech input signals, wherein said monitoring means comprises first means for determining if said one characteristic of said input signal for a present interval meets at least a first criterion of a signal representing speech and wherein said discriminating means comprises second means responsive to a determination of speech by said first means for setting a predetermined hangover time in accordance with a number of consecutive intervals for which said input signal has been determined to satisfy said first criterion, and third means responsive to a determination by said first means that said input signal does not satisfy said criterion for determining non-speech in accordance with a number of consecutive intervals for which said criterion has not been satisfied and in accordance with the hangover time set by said second means.

35. A speech analysis and synthesis method comprising the steps of:

deriving a set of synthesis parameters for each frame from an original input signal having a plurality of successive frames including a current frame, a previous frame and a next frame, with each frame having first, second and third portions, said step of deriving said synthesis parameters comprising:

generating a set of first parameters corresponding to each frame of said input signal, each set of first parameters for a given frame including first, second and third subsets corresponding to said first, second and third portions of the given frame;

generating an interpolated first subset of parameters by interpolating between said first subsets of said current and previous frames;

generating an interpolated third subset of parameters by interpolating between said third subsets of said current and next frames;

combining said interpolated first subset, said second subset and said interpolated third subset of parameters to form a set of synthesis parameters for said current frame;

transmitting the synthesis parameters to a decoder; and synthesizing the original input speech signal in accordance with said transmitted synthesis parameters.

36. A speech analysis and synthesis method as define din claim 35, wherein said first set of parameters comprise line spectrum frequencies.

37. A speech analysis and synthesis method, comprising:

deriving a set of spectrum filter coefficients for each frame from an original input signal representing speech and having a plurality of successive frames;

converting said spectrum filter coefficients to an ordered set of n frequency parameters ($f_1, f_2, \ldots, f_n$), where n is an integer;

determining if any magnitude ordering has been violated, i.e., if $f_i < f_{i-1}$, where i is an integer between 1 and n;

if any magnitude ordering has been violated, rearranging said frequency parameters by reversing the order of the two frequencies $f_i$ and $f_{i-1}$ which resulted in the violation;

converting said frequency parameters, after any rearrangement if that has occurred, back to spectrum filter coefficients; and synthesizing said original input signal representing said speech in accordance with the spectrum filter coefficients resulting from said converting step.

38. A speech analysis and synthesis method as defined in claim 37, wherein said frequency parameters comprise line spectrum frequencies.

39. A speech analysis and synthesis method comprising the steps of:

generating a plurality of analysis signals from an input signal, said analysis signals comprising at least a pitch value, a pitch gain value, an excitation codeword and an excitation gain signal, quantizing said analysis signals, wherein said quantizing step comprises:

quantizing said pitch value directly by classifying said pitch value into one of a plurality of $2^m$ value ranges, where m is an integer, with m quantization bits representing the classification value; and quantizing said pitch gain by selecting a corresponding codeword from a codebook of $2^n$ codewords, where n is an integer, with n quantization bits representing the selected codeword;

providing the quantized analysis signals to a decoder, and synthesizing said speech signal in accordance with the quantized signals at the decoder.

40. A speech analysis and synthesis method as define din claim 39, wherein $n<m$.

41. A speech analysis and synthesis method as define din claim 39, wherein said quantizing step further comprises:

representing said excitation codeword with k bits indicating the one of $2^k$ codewords from which said excitation codeword was selected; and quantizing said excitation gain by selecting a corresponding codeword from a codebook of $2^l$ previously computed excitation gain codewords, where l is an integer, with l quantization bits representing the selected excitation gain codeword.

42. A speech analysis and synthesis method as defined in claim 41, wherein $l<k$.

* * * * *

UNITED STATES PATENT AND TRADEMARK OFFICE

CERTIFICATE OF CORRECTION

PATENT NO. : 5,307,441

DATED : April 26, 1994

INVENTOR(S) : Tzeng

It is certified that error appears in the above-identified patent and that said Letters Patent is hereby corrected as shown below:

Item [54] - Title Line - delete "Wear-Toll Quality 4.8 KBPS Speech Codec" and insert --Near-Toll Quality 4.8 KBPS Speech Codec--.

Signed and Sealed this

Sixth Day of September, 1994

Bruce Lehman

*Attest:*

BRUCE LEHMAN

*Attesting Officer*

*Commissioner of Patents and Trademarks*